US005386875A

United States Patent [19]

Venditto et al.

[11] Patent Number: 5,386,875

[45] Date of Patent: * Feb. 7, 1995

[54] METHOD FOR CONTROLLING SAND PRODUCTION OF RELATIVELY UNCONSOLIDATED FORMATIONS

[75] Inventors: James J. Venditto; William E. Martch; J. Michael Wilson, all of Duncan, Okla.

[73] Assignee: Halliburton Company

[ * ] Notice: The portion of the term of this patent subsequent to Nov. 1, 2011 has been disclaimed.

[21] Appl. No.: 108,368

[22] Filed: Aug. 18, 1993

Related U.S. Application Data

[63] Continuation-in-part of Ser. No. 992,847, Dec. 16, 1992.

[51] Int. Cl.[6] ..... E21B 43/26

[52] U.S. Cl. ..... 166/308; 166/280

[58] Field of Search ..... 166/250, 308, 271, 297, 166/280

[56] References Cited

U.S. PATENT DOCUMENTS

| | | | |
|---|---|---|---|
| 2,248,028 | 7/1941 | Prutton et al. . | |
| 2,788,072 | 4/1957 | Goodwin et al. . | |
| 3,070,160 | 12/1962 | Reistle, Jr. . | |
| 3,180,416 | 4/1965 | Smith . | |
| 3,294,166 | 12/1966 | Havenaar et al. . | |
| 3,336,980 | 8/1967 | Rike . | |
| 3,343,600 | 9/1967 | Phansalkar et al. . | |
| 3,373,812 | 3/1968 | Smith . | |
| 3,646,999 | 3/1972 | Hamby, Jr. et al. . | |
| 3,747,678 | 7/1973 | Wald . | |
| 3,815,680 | 6/1974 | McGuire et al. . | |
| 4,194,577 | 3/1980 | Vann . | |
| 4,220,205 | 9/1980 | Couisen et al. | 166/308 X |
| 4,549,608 | 10/1985 | Stowe et al. . | |
| 4,621,692 | 11/1986 | Mondshine . | |
| 4,714,115 | 12/1987 | Uhri | 166/308 |
| 4,848,468 | 7/1989 | Hazlett et al. | 166/300 |
| 4,869,322 | 9/1989 | Vogt, Jr. et al. | 166/308 X |
| 4,889,186 | 12/1989 | Hanson et al. | 166/308 X |
| 5,025,859 | 6/1991 | Hanson et al. | 166/308 |
| 5,105,886 | 4/1992 | Strubbar et al. . | |
| 5,111,881 | 5/1992 | Soliman et al. | 166/308 X |

*Primary Examiner*—William P. Neuder
*Attorney, Agent, or Firm*—Robert A. Kent

[57] ABSTRACT

An improved method for fracturing oil wells is disclosed and claimed herein. In particular, the present invention involves the determination of the direction of fracture propagation, i.e., perpendicular to the minimum stress existing within a given formation and the alignment of perforations produced by a variety of perforating devices with the previously determined direction of fracture propagation. The methods disclosed and claimed herein will eliminate many problems encountered in the prior art, including reducing the pressure required to initiate fractures and reducing the undesirable effects of near wellbore tortuosity. A solidified compound may be placed proximate the fractures to further limit undesirable sand production.

14 Claims, 9 Drawing Sheets

Fig. 1a
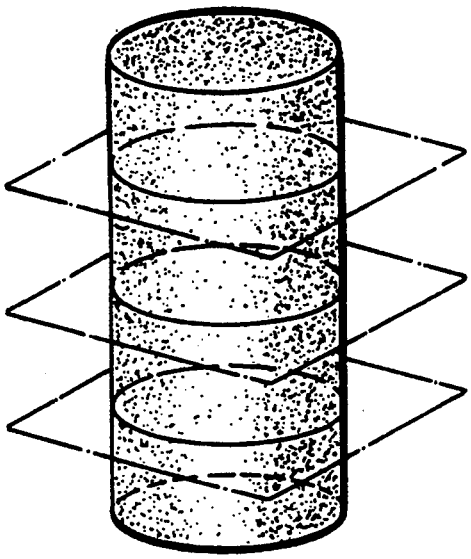
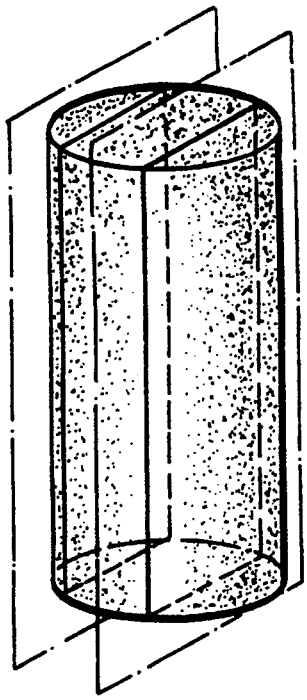
Fig. 1b
Fig. 2
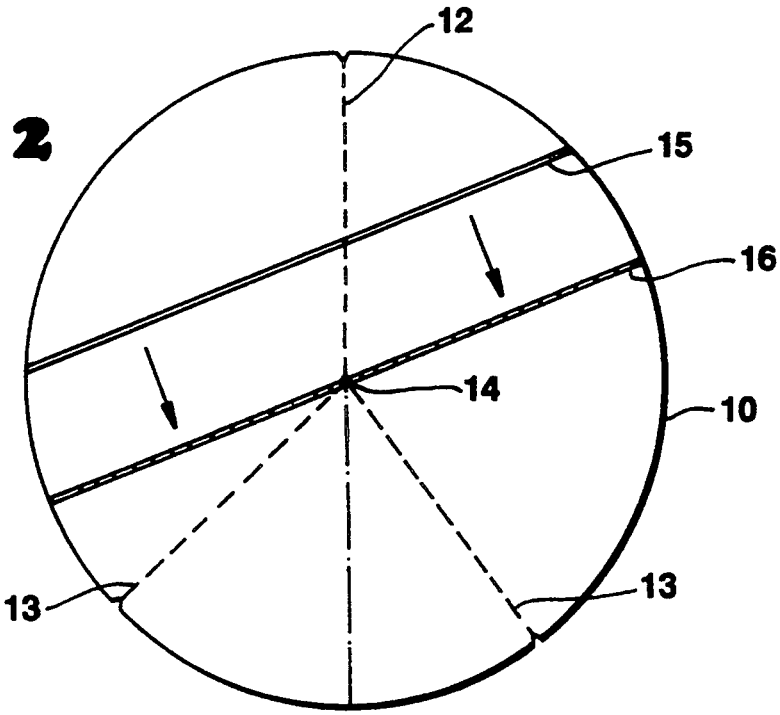

METHOD FOR CONTROLLING SAND PRODUCTION OF RELATIVELY UNCONSOLIDATED FORMATIONS

This application is a continuation-in-part of application Ser. No. 07/992,847, filed Dec. 16, 1992.

BACKGROUND OF THE INVENTION

The present invention relates generally to improved methods for perforating wells, such as oil and gas wells, and particularly to methods for generally aligning perforations along the direction relative to horizontal stress in the formation surrounding the wellbore.

In the completion of oil and gas wells, it is common to utilize multiple charge perforating guns to perforate the well casing and the formation surround the wellbore within a zone of interest. Such perforations may be directed toward one side of the wellbore or another. For example, see U.S. Pat. No. 4,194,577 issued Mar. 25, 1980 to Roy R. Van, and entitled "Method and Apparatus for Completing a Slanted Wellbore." U.S. Pat. No. 4,194,577 discloses orienting a perforating sun through gravity to perforate the low side of a non-vertical wellbore. Techniques have been proposed in co-pending parent application Ser. No. 897,538, filed Jun. 11, 1992, in the names of some of the inventors named herein, for determining the direction of stress fields within a formation, and for orienting perforations relative to those stress fields to promote efficient, subsequent, hydraulic fracturing of the formation. The orientation apparatus is described also in application Ser. No. 897,257, filed Jun. 11, 1992, by James J. Venditto, David McMechan, Calvin Kessler, and Harold E. Peelman.

Some formations, however, such as those conventionally referred to as "loosely consolidated" or "unconsolidated" formations, often present problems in the production of sand or larger formation pieces. A relatively high production rate from a relatively loosely consolidated formation typically results in a relatively increased pressure drawdown across the formation proximate the wellbore (i.e., in the "near wellbore area"). This pressure drawdown places increased stress on the formation. Where this stress (coupled with the pre-existing in situ stress) exceed s the shear strength on the formation, failure of the formation will typically occur, leading to sand production from the well.

In such circumstances, conventional practice is to install some type of sand control apparatus within the well. This may include merely placing a prepacked gravel pack screen within the well to minimize solids production into the wellbore. Production through such a pre-packed screen, however, may often become reduced over time due to collapsing and compacting of the formation around the screen.

Another, more expensive, remedy is to gravel pack the perforated zone by placing a volume of gravel in the formation, and actually in the perforations surrounding the well, to maintain the perforations in an open condition. Many techniques for gravel packing are well known to the industry. In general, however, gravel packing a well adds substantial additional time and expense to the process of completing the well. As a result, in many cases the decision as to whether or not to gravel pack a well will be based upon factors including how the unconsolidation of the formation, the resulting sand production and other disadvantages associated therewith, may be balanced against the cost of the gravel pack. At least in some cases, wells could be completed more efficiently if it were possible to minimize sand production from a well in a loosely consolidated or unconsolidated formation.

Accordingly, the present invention provides a new method and apparatus for determining the stress fields within the formation in the zone of interest surrounding a wellbore and for orienting the perforating gun to orient the perforations relative to the determined stress fields to thereby minimize sand production from the well. This method and apparatus have the further advantages that should the well be subsequently fractured, where the perforations are oriented generally in line with the maximum horizontal stress within the formation, the perforation tunnel will retain maximum stability; and any subsequent hydraulic fracturing operations should result in a maximum near-wellbore fracture width, and a desirable single fracture of maximum dimension.

SUMMARY OF THE INVENTION

The present invention is directed to a method for improving the perforation tunnel stability of formation perforations, and also for optimizing subsequent hydraulic fracturing operations by generally aligning wellbore perforations with the direction of the maximum principal horizontal stress existing within the formation surrounding the wellbore. The direction of maximum horizontal stress in the formation may also be considered as the direction of fracture propagation. In an unclosed portion of a wellbore, application of hydraulic pressure to a formation will typically cause a fracture along the axis of maximum horizontal stress. This perforation orientation offers the advantage of establishing optimally stable perforation tunnels, and thereby limiting the undesirable production of sand or other formation pieces from the well. The present method may be used on both vertical and deviated wells, e.g. horizontal wells or wells drilled at an angle relative to a vertical well. Where fracturing operations follow the perforations, fractures may be initiated at lower pressures, and problems associated with near wellbore tortuosity may be avoided.

The method of the present invention may be performed through use of any of several different techniques to determine the orientation of stress fields within a formation. One representative method involves performing a small volume hydraulic fracturing (microfrac) test in an open wellbore in a formation, and thereafter taking an oriented core from the formation and observing the direction of the induced fracture where it intersects the core. Such observation may be made visually or through use of computed tomography (CT) techniques. Another representative technique is the use of a downhole tool to measure borehole deformation before and after fractures have been initiated in the wellbore, and, based upon that data, determining the direction of fracture propagation within a formation. Additionally, the direction of fracture orientation may also be determined through use of various strain relaxation measurements which are known to those skilled in the art. Apparatus for performing such strain relief measurement is disclosed in U.S. Pat. Nos. 4,673,890; 4,625,795; and 4,800,753. Yet another representative technique would be the use of an oriented downhole circumferential acoustic scanning tool (CAST) that allows observation of the fractures in the formation as they are initiated, or open and close, thereby allowing determination of the direction of fracture propagation.

After the orientation of the stress field is determined, an oriented perforating device is positioned such that the perforations produced when such device is fired will be generally aligned with the direction of the maximum horizontal stress field.

In one implementation of the present invention, a particle retaining compound, such as a resinous compound or a plasticizing compound, will be spotted proximate the perforations. The particle retaining compound will thereby serve to maintain the formation in a relatively stable state. This further facilitates a performing of subsequent operations, which may include subsequent fracturing of the well or placing the well on production.

BRIEF DESCRIPTION OF THE DRAWINGS

FIG. 1A is a cross-sectional view of a horizontal CT scan image through a cylinder core.

FIG. 1B is a cross-sectional view of axial and longitudinal CT scan images through a cylindrical core.

FIG. 2 is a schematic for obtaining fracture orientation from CT slice data in reference to orientation scribes.

DETAILED DESCRIPTION OF PREFERRED EMBODIMENTS

Figure 3:
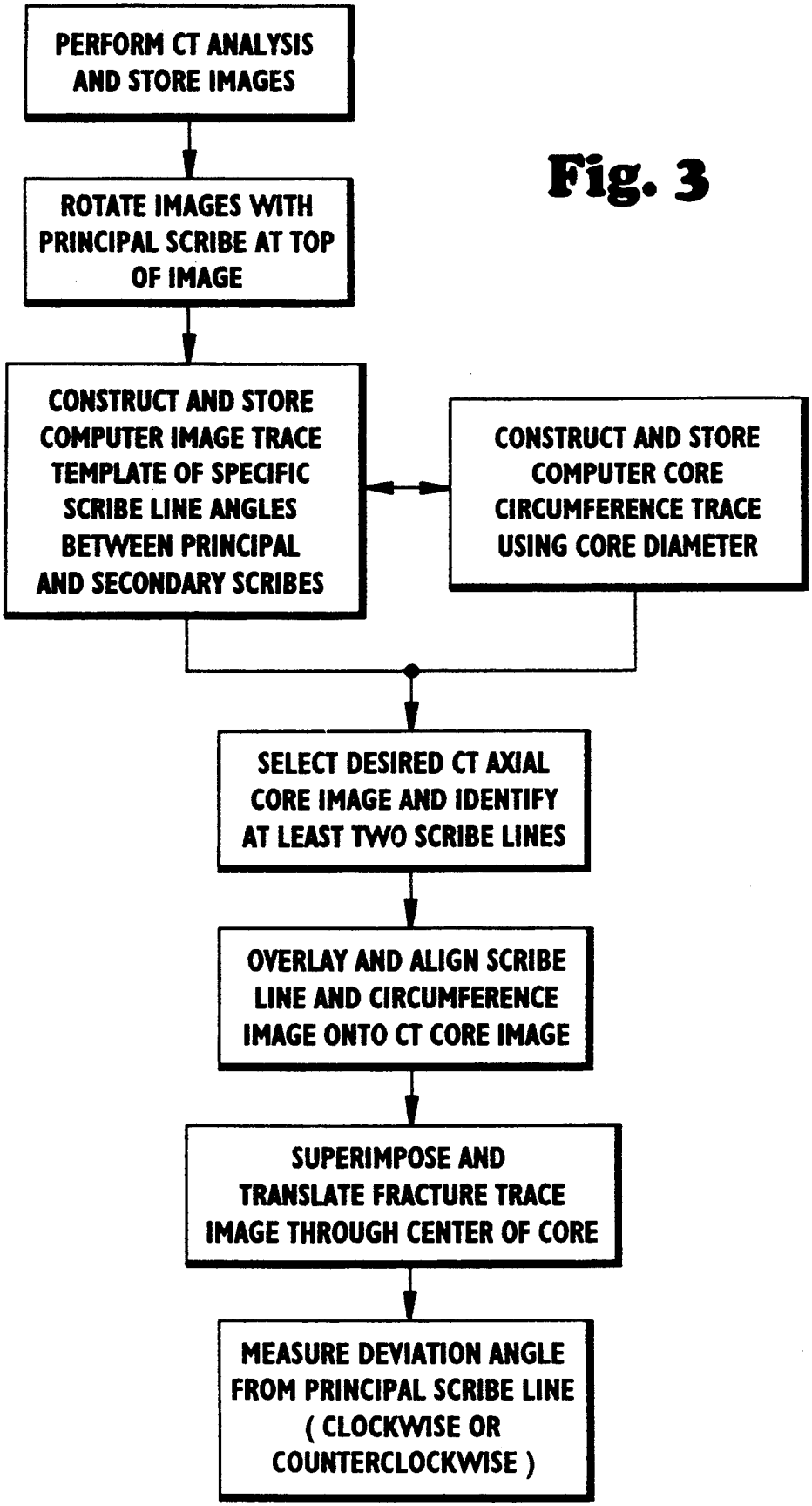
FIG. 3 is a flowchart representing the steps of a computer software program for measuring the orientation of a fracture.

The stress field around a wellbore is most likely to result in compressive shear failure of the formation in the direction of the minimum horizontal stress. The maximum stress concentration occurs in the direction of the minimum horizontal stress; while the minimum stress concentration is in the direction of the maximum horizontal stress. The shear failure of a formation is a function of the ratio of the minimum to maximum horizontal stresses, the cohesive strength of the formation and the coefficient of internal friction.

Where the ratio of minimum to maximum horizontal stresses is high, and where the cohesive strength of the formation is low, perforation tunnels extending generally in the direction of the minimum horizontal stress field are relatively prone to collapse or otherwise deteriorate, potentially resulting in the production of sand or other formation particles from the well. In contrast, perforation tunnels extending in the direction of the maximum horizontal stress are less likely to deteriorate to cause such problems. Additionally, perforations oriented in such manner should provide optional points from which formation fractures may subsequently be initiated.

Utilizing conventional techniques, whenever a well is fractured, there is no way to assure at which radially distributed perforation sites a fracture will initiate. Sometimes, the fractures initiate at a perforation site that is not aligned with the direction in which the fracture will propagate through the formation. Generally speaking, the initiation of a fracture at a perforation site is less dependant upon the direction of the perforation than it is upon the local stress conditions of the formation immediately adjacent to the perforation tunnel. In fact, whether a fracture initiates at a given perforation site is greatly affected by the extent of damage caused to the formation during the perforation process. Therefore, fractures may be initiated at nonaligned perforation sites, even though the initiation and propagation of a fracture at a nonaligned perforation site would, in theory, require higher pressures than would be required to initiate and propagate a fracture at a perforation site aligned with the direction of fracture propagation. In general, with use of conventional perforation techniques, orientation of a perforating device was a substantial problem in that few, if any, perforations produced by such device would align with the plane of an inferred fracture, such as that determined by a microfrac test.

By way of example only, assume that the direction of fracture propagation existing within a field is along a horizontal line that corresponds to the 0°–180° axis of a horizontal plane passing through the wellbore when viewed from above. During fracturing operations, a fracturing fluid is pumped into the wellbore under high pressure to induce and propagate the fracture. This operation may result in the initiation and propagation of a fracture in a nonaligned perforation tunnel (which is typically 6″–15″ in length), e.g., a tunnel oriented at 30°. Thereafter, after the initial fracture has propagated a given distance away from the wellbore, approximately 2–3 wellbore diameters, the fracture will turn towards, or align with, a direction perpendicular to the minimum principle stress existing within the formation (i.e., align with the maximum horizontal stress field), to reduce the energy required to propagate the fracture. This results in a curved flow path through which the fracturing fluid must be pumped to complete the fracturing operations. This phenomenon, which is commonly referred to as near wellbore tortuosity, causes many problems during fracturing procedures.

The phenomenon of near wellbore tortuosity may also occur under distinctly different circumstances. In particular, if a good seal is not achieved between the cement and the formation in a cased well, and if the fracturing fluid has access to the cement-formation interface, then fractures may be initiated on the surface of the wellbore face in a direction perpendicular to the minimum principle stress in the formation, and not at one of the perforation sites. Since the energy required to fracture the formation in the direction of the nonaligned perforations is larger than the energy required to propagate the fractures at the wellbore face, a curved or convoluted flow path for the fracturing fluid may be established between the perforations and the fractures initiated at the wellbore face as the fracturing fluid flows between the cement and the formation.

The near wellbore tortuosity phenomenon can result in excessively high pressure drops as the fracturing fluid is pumped through the fractures initiated in the nonaligned perforation tunnels. This curved flow path for the fracturing fluid may also result in fracture narrowing for two reasons. First, since the perforation tunnel is not aligned with the natural direction of fracture propagation, the force required to induce and propagate the fracture initiated at the nonaligned perforation tunnel necessarily exceeds the minimum principle stress in the field, thereby resulting in a narrower fracture then would be produced if the perforations, and resulting fractures, were aligned with the direction of fracture propagation. Additionally, since a given well has a maximum allowable well head pressure, the pressure drop incurred in pumping the fracturing fluid through the nonaligned perforation tunnels limits the energy available to propagate the main fracture fully into the formation, i.e., if excessive pressure drop is encountered in pumping the fracturing fluid through a fracture initiated at a nonaligned perforation tunnel, then a lesser amount of energy will be available to further open the fractures and force them further into the formation.

Another problem that may be encountered is bridging the fracture with proppants typically used in fracturing procedures. In particular, if a fracture is aligned perpendicular to the direction of minimum principle stress, then the main body of the fracture may be as much as approximately ½" wide. However, in the case of fractures induced in nonaligned perforation tunnels, the width of the fracture may be significantly narrower. Given that proppants typically used in fracturing fluids may be approximately 0.026" in diameter, there exist a real possibility that proppants may bridge in the narrower fractures initiated in nonaligned perforation tunnels. If this occurs, then fracturing operations may be prematurely terminated which, results in, at best, an inefficient well.

Although the tortuous path created as a result of fractures being initiated in nonaligned perforation tunnels is not directly observable from the surface during fracturing operations, the effects of near wellbore tortuosity may be observed. In particular, if the fracturing fluid must be pumped at pressures substantially in excess of the pressure required to hold the fractures open, then it is likely that any additional pressure drop is associated with this phenomenon of near wellbore tortuosity. Given the relatively short length of the initial fractures, if the pressure drop associated with the flow of fluid through the initial fractures is relatively large, then the high pressure drop must be due to the losses incurred in forcing the fracturing fluid through a very narrow fracture over such a short distance.

The present inventive methods and procedures overcome these as well as other problems existing due to this phenomenon by determining the direction of existing horizontal stress fields, and the response of hydraulic fracture propagation within a formation, and providing a mechanism for aligning the perforations produced with any of several known prior art devices with the previously determined direction of maximum horizontal stress in the formation.

In particular, the direction or azimuth of formation stress fields may be determined using any of a variety of methods. Representative methods include: 1) performing an open hole microfrac test and thereafter taking an oriented core from below the bottom of the wellbore, thereby allowing observation of the direction of the induced fracture, and determination of maximum azimuthal stress, in the core; 2) using computed tomography (CT) techniques to determine fracture direction and rock anisotropy from an oriented core that is obtained after an open hole microfrac test; 3) employing a high precision multi-armed caliper, such as the Total Halliburton Extensiometer, to measure the borehole deformation before and after fracturing to determine the fracture direction; 4) performing strain relaxation measurements on an oriented core obtained from the relevant area of observation to determine the direction of least principle stress existing within the field; and 5) using an oriented downhole tool, such as Halliburton's Circumferential Acoustic Scanning Tool (CAST), to provide a full borehole image which allows direct observation of an induced fracture during fracturing operations. However, these methods are merely representative techniques that may be employed to determine the direction of fracture propagation, and should not be considered as specific limitations of this invention. Each of these methods will be discussed more fully herein.

1. Visual Observation Of The Direction Of An Induced Fracture In An Oriented Core The techniques and methods employed during the open hole microfrac test to determine the direction of fracture propagation, and thus of the maximum horizontal stress field, are fully disclosed in U.S. Pat. No. 4,529,036, which is hereby incorporated herein by reference. Generally speaking, during an open hole microfrac test, microfractures are induced in an open hole wellbore by pumping a relatively small amount of fracturing fluid into the wellbore. Since this technique is employed in an open wellbore, these fractures will naturally align with the direction of fracture propagation, i.e., perpendicular to the minimum principle horizontal stress existing within the formation. Additionally, this procedure results in the initiation of fractures in the formation for a given depth under the bottom of the open hole wellbore.

Thereafter, an oriented core sample is taken from the formation. The orientation of the core is determined by certain orientation grooves, both principal and secondary scribe lines, that are marked on the core as the core is being cut. Knives inside the core barrel cut the scribe lines as the core enters the core barrel. The orientation of the principal scribe with respect to a compass direction is recorded prior to running the core barrel into the borehole. Thus, one can determine the orientation of the principal scribe line from the compass readings at each recorded interval. The secondary scribe lines are used as a reference for identifying the principal scribe. A survey record will exist at the conclusion of the cored section which accurately reflects the orientation of the core's principal scribe line throughout the interval. Orientation of the core is considered a critical part of obtaining accurate orientation measurements of planar core features such as fractures.

Once the oriented core is removed from the well, it is visually inspected to determine the direction of fracture propagation. This method has the additional benefit that the fracture direction is determined from observation of a fracture existing below the well, i.e., as it exists in the formation in its natural state away from the effects of the drilling operations. Typically, this procedure may be used to determine the direction of fracture propagation above, below, and within the area of the formation under consideration.

2. Observation Of The Direction Of An Induced Fracture In An Oriented Core Through Use Of Computed Tomography Imagery Fracture orientation may also be determined through use of computed tomography (CT) techniques, commonly known in the medical field as CAT scanning ("computerized axial tomography" or "computed assisted tomography"). This method is the subject of a separate pending patent application which is also assigned to the assignee of the present application (application Ser. No. 897,256, filed Jun. 11, 1992, by Matthew E. Blauch and James J. Venditto).

In this method, fractures are induced in the formation through use of the microfrac technique, thereafter an oriented core is taken from the bottom of the wellbore. However, in this method, the oriented core sample remains inside a sleeve surrounding the core throughout the analysis of the core. Although this technique may be employed on any type of formation, it is particularly useful when dealing with friable type formations that prohibit physical handling of the core sample. The CT techniques allows observation of the direction of fractures as well as orientation directions on the core, and thereby allow determination of the direction of fracture propagation.

By way of background, CT technology is a nondestructive technology that provides an image of the internal structure and composition of an object. What makes the technology unique is the ability to obtain imaging which represents cross sectional "axial" or "longitudinal" slices through the object. This is accomplished through the reconstruction of a matrix of x-ray attenuation coefficients by a dedicated computer system which controls a scanner. Essentially, the CT scanner is a device which detects density and compositional differences in a volume of material of varying thicknesses. The resulting images and quantitative data which are produced reflect volume by volume (voxel) variations displayed as gray levels of contrasting CT numbers.

Although the principles of CT were discovered in the first half of this century, the technology has only recently been made available for practical applications in the non-medical areas. Computed tomography was first introduced as a diagnostic x-ray technology for medical applications in 1971, and has been applied in the last decade to materials analysis, known as non-destructive evaluation. The breakthroughs in tomographic imaging originated with the invention of the x-ray computed tomographic scanner in the early 1970's. The technology has recently been adapted for use in the petroleum industry.

A basic CT system consists of an x-ray tube; single or multiple detectors; dedicated system computer system which controls scanner functions and image reconstructions and post processing hardware and software. Additional ancillary equipment used in core analysis include a precision repositioning table; hard copy image output and recording devices; and x-ray "transparent" core holder or encasement material.

A core may be laid horizontally on the precision repositioning table. The table allows the core to be incrementally advanced a desired distance thereby ensuring consistent and thorough examination of each core interval. The x-ray beam is collimated through a narrow aperture (2 mm to 10 mm), passes through the material as the beam/object is rotated and the attenuated x-rays are picked up by the detectors for reconstruction. Typical single energy scan parameters are 75 mA current at an x-ray tube potential of 120 kV. After image reconstruction, a cross-sectional image is displayed and the data stored on tape or directly to a computer disk. One example of obtaining image output through hard copies in the form of 35 mm slides directly from image disks which may then be reproduced into 8.5×11 inch photographic sheets directly from the slides. However, other output displays are possible and other image displays are readily available and known to those skilled in the art.

A cross sectional slice of a volume of material can be divided into an n×n matrix of voxels (volume elements). The attenuated flux of $N_o$ x-ray photons passing through any single voxel having a linear attenuation coefficient $\mu$ reduces the number of transmitted photons to N as expressed by Beer's law:

$$N/N_o = e^{-\mu/x}$$

where:

N=number of photons transmitted $N_o$=original number of emitted photons x=dimension of the voxel in the direction of transmitted beam $\mu$=linear attenuation coefficient (cm).

Material parameters which determine the linear attenuation coefficient of a voxel relate to mass attenuation coefficient as follows:

$$\mu \leqq (\mu/\rho)\rho$$

where:

$(\mu/\rho)$ is the mass attenuation coefficient (MAC) and $\rho$ is the object density. Mass attenuation coefficients are dependent on the mean atomic number of the material in a voxel and the photon energy of the beam [approx. $(KeV)^{-3}$]. For a heterogeneous voxel, i.e., compounds and mixtures, the atomic number depends on the weighted average of the volume fraction of each element (partial volume effect). Therefore, the composition and density of the material in a voxel will determine its linear attenuation coefficient.

Computed tomography calculates the x-ray absorption coefficient for each pixel as a CT number (CTN), whereby:

$$CTN = 1000\,\frac{\mu - \mu_w}{\mu_w}$$

where:

$\mu_w$ is the linear attenuation coefficient of water.

Conventionally, CT numbers are expressed as normalized MAC's to that of water. The units are known as Hounsfield units (HU) and are defined as 0 HU for water and (−1000) HU for air. Rearrangement of the previous equation can therefore be expressed as:

$$\text{CTN (CT number)} = 1000 \times ((\mu/\rho)\rho/(\mu/\rho)_w\rho_w - 1)$$

where:

$(\mu/\rho)_w$=mass attenuation coefficient of water $\rho_w$=density of water

Core lithology can be determined by single scan CT with the knowledge of the density (or grain density) and attenuation coefficient of the material. For sandstones, limestones, and dolomites, the grain densities are usually close to the mineral values found in the literature (2.65, 2.71, and 2.85 g/cm$^3$, respectively). Typical densities can also be used for rock or mineral types such as gypsum, anhydrite, siderite, and pyrite.

The mass attenuation coefficients of various elements and compounds can be found in the nuclear data literature. The mass attenuation coefficient for composite materials can be determined from the elemental attenuation coefficients by using a mass weighted averaging of each element in the compound as shown:

$$MAC = \frac{\Sigma M_i (MAC)_i}{\Sigma M_i}$$

where $M_i$ is the molecular weight for element i.

Note that calcite MAC values are higher than those for dolomite, even though dolomite has a higher grain density than calcite. This is because of the atomic number dependence. Water and decane have very similar MAC values. The higher atomic number (and MAC value) materials are more nonlinear with x-ray energy than the lower atomic number materials.

In general, sandstones or silicon-based materials have CT numbers in the 1000–2000 range, depending on the core porosity. Limestones and dolomites are typically in the 2000–3000 CTN range.

Small impurities of different elements in a core can change the core's CT numbers. For instance, the presence of calcium in a sandstone core matrix will increase the core's CT number above what would be predicted from the porosity vs. CTN curve. An estimate of the weight fraction of each element in the core can give a better estimate of the core porosity.

The occurrence of abrupt changes in CT number may indicate lithology discontinuities in the core. For instance, the presence of small high density/high CT number nodules (CTN<2000) usually indicates the presence of iron mineralization in the core (pyrite, siderite, glauconite). For limestones the presence of higher density/CTN nodules (CTN>3400) in the limestone matrix may indicate anhydrite in the core. A high CTN/high density region near the outer part of the core may indicate barite mud invasion.

Quantitative CT scanning of cores requires modifications to the techniques employed for medical applications. The CT scanner must be tuned for reservoir rocks rather than water in order to obtain quantitatively correct measurements of CT response of the cores. Since repeat scanning of specific locations in the sample is often necessary, more accurate sample positioning is required than is needed in medical diagnostics.

The specific techniques employed to determine the direction of fracture orientation by this method will now be discussed. Prior to coring the targeted reservoir, a fracture is induced by a microfrac treatment. Typically, drilling is stopped once the desired area of testing has been reached, i.e., after penetrating the top of the formation. An open hole expandable packer is set in the borehole above the formation to be tested. Typically, the packer would be set to expose 10–15 feet of hole. A microfrac treatment uses a very slow injection rate and 1–2 barrels of drilling mud or other suitable fluid to create a small fracture in the formation.

After the microfrac treatment is terminated, the open hole packer is removed from the borehole. The microfrac is followed by the drilling and recovery of an oriented core specimen from the formation (the orientation of a core sample has been discussed previously). This core will contain part of the actual fracture or fractures created during the microfracture treatment. The orientation of the induced fracture or fractures will indicate the direction of the least principal stress as the fracture will propagate in a direction perpendicular to the least principal stress.

The core would preferably be contained in a core tube which is removed at the surface from the core barrel used to cut the core. The core tube is typically made of fiberglass, aluminum or other suitable materials. The depth of the cored interval is noted on the core tube as it is removed from the core barrel. The core tube with the core inside is sent to a lab having computed tomography facilities for analysis.

The core tube, with the core inside, may be preferably placed horizontally on a precision repositioning table. A computerized tomographic scanner (CT scanner) will take a series of two dimensional slice images of the core. These slice images can be used individually or collectively for analysis or may be reconstructed into three dimensional images for analysis. The scanner consists of a rotating x-ray source and detector which circles the horizontal core on the repositioning table. The table allows the core to be incrementally advanced a desired distance thereby ensuring consistent inspection of each core interval. X-rays are taken of the core at desired intervals. The detector converts the x-rays into digital data that is routed to a computer. The computer converts the digital x-ray data into an image which can be displayed on a CRT screen. These images are preferably obtained in an appropriate pixel format for full resolution. A hard copy of the image can be obtained if desired. The image represents the internal structure and composition of the core and/or fractures.

CT images can be obtained which represent cross-sectional "axial" or "longitudinal" slices through the core. Axial and longitudinal scan slices are illustrated in FIG. 1*a* and 1*b*, respectively. For axial images, CT scan images are taken perpendicular to the longitudinal axis of the core. A longitudinal image is created by reconstructing a series of axial images. Images can be obtained along the entire length of the core at any desired increment. Slice thickness typically range from 0.5 mm to 2.0 mm. The images thus obtained can discern many internal features within a formation core including cracks, hydraulic and mechanically induced fractures, partially mineralized natural fractures and other physical rock fabrics. These features are represented by CT numbers which differ from the CT number of the surrounding rock matrix. A CT number is a function of the density and the atomic number of the material. For a given mineralogy, a higher CT number represents a higher density and therefore a lower porosity. Due to the high CT number contrast between an opened induced fracture and the surrounding rock matrix, the induced fracture can be observed directly in the images even though a narrow hairline fracture may not be readily observed on the outside perimeter of the core.

FIG. 2 represents a schematic of the procedure for obtaining fracture orientation from a CT image. Using an axial slice image from the recovered core, the CT computer generates a circumferential trace 10 about the circumference of the core image. The principle and secondary scribe marks on the oriented core will appear as indentation on the circumference of the scan image. From these indentations, the computer generates the principal 12 and secondary 13 scribe lines on the image. The intersection of the principle and secondary scribe lines coincide with the geometric center 14 of the image. The induced fracture 15 is then identified on the core image. Since a fracture will rarely be in the center of the core, it is necessary to translate the fracture orientation to the center of the core image.

A trace of the fracture is created by translating and projecting the fracture orientation through the geometric center 14 of the circumference of the core, as indicated by the arrows in FIG. 2. The fracture trace 16 will be parallel to the induced fracture 15 identified in the scan image. The angle between the principal scribe 12 and the fracture trace 16 is measured along the circumferential trace of the core image with a positive (clockwise) or negative (counterclockwise) angle. In other words, compass direction or azimuthal strike orientation is measured from the principal scribe to where fracture trace 16 intersects the circumferential trace of the core image. When the compass orientation for the principal scribe mark at the image core depth is determined from the core orientation data, the angle between the principal scribe line and the fracture trace is then converted to azimuthal orientation with respect to true north. This process can be performed through manual measurements or automatically through a computer software program which performs the angle measurement and calculation. A flow chart representing the steps of a computer software program for measuring the orientation of a fracture is illustrated in FIG. 3. The strike orientation of other planar rock features may also be determined by the same procedure.

Two example calculations of induced fracture strike orientation are provided for clockwise and counterclockwise angle measurements from the principal scribe. The following formula is used in the calculation:

$$S_1+D=S_2$$

where:

$S_1$=Principal scribe orientation at an indicated depth in degrees east or west of north from 0 to 90.

D=Angle deviation from the principal scribe of the fracture trace projected through the core center intersected at the core perimeter. Clockwise angles from the principal scribe are designated as positive values. Counterclockwise angles from the principal scribe are designated as negative values.

$S_2$=Resultant induced fracture strike orientation with respect to true north (degrees east or west of north).

NOTE: The sign of the deviation angle (D) will be reversed when $S_2$ changes from the NE to the NW quadrant.

Example 1:

Extrapolated $S_1$ orientation from true north=N52E.

CT measured deviation angle D=+8

$S_1+D=S_2$

52+(+8)=60 degrees

Induced fracture strike orientation ($S_2$)=N6OE

Example 2

Extrapolated $S_1$ orientation from true north=N81.5E.

CT measured deviation angle D=−22

$S_1+D=S_2$ 81.5+(−22)=58.5 degrees

Induced fracture strike orientation ($S_2$)=N58.5E

Both examples were obtained from identified induced fractures obtained at two different depth markers from an oriented core retrieved from competent Devonian shale in Roane Co. West Virginia. Note consistency of induced fracture strike despite rotation of the principal scribe orientation in the recovered core.

Figure 4:
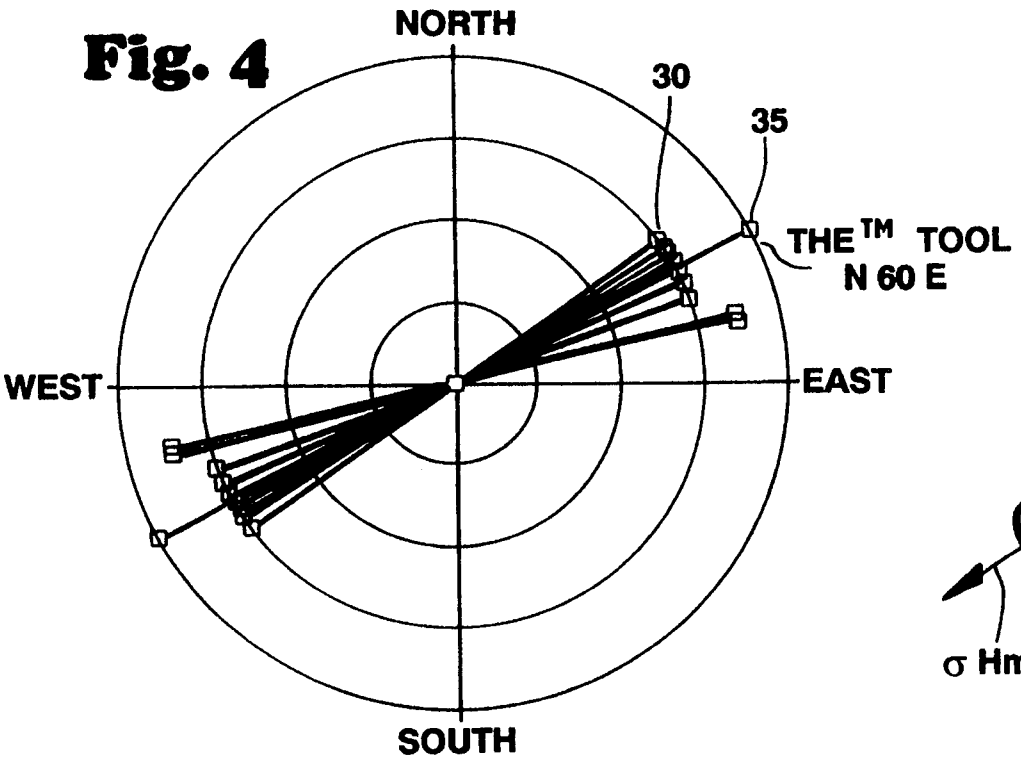
FIG. 4 is an induced fracture strike orientation plot.

FIG. 4 shows a series of induced fracture data points, identified collectively as 30, at two different core depths in two core intervals. As can be seen in FIG. 4, this data supports the single point downhole hydraulic fracture orientation obtained from a downhole extensionmeter device, 35, in the same well, with the median of 11 core induced data points being within 2 degrees of the inferred hydraulic fracture orientation obtained by use of the Total Halliburton Extensionmeter, another technique fully disclosed herein. The data points shown in FIG. 3, were obtained from the Devonian shale described above, in Roane Co., West Virginia. The orientation of the minimum in-situ stress would be inferred to be substantially perpendicular to the induced fracture orientation, which in FIG. 4 would be approximately N30W.

Figure 5:
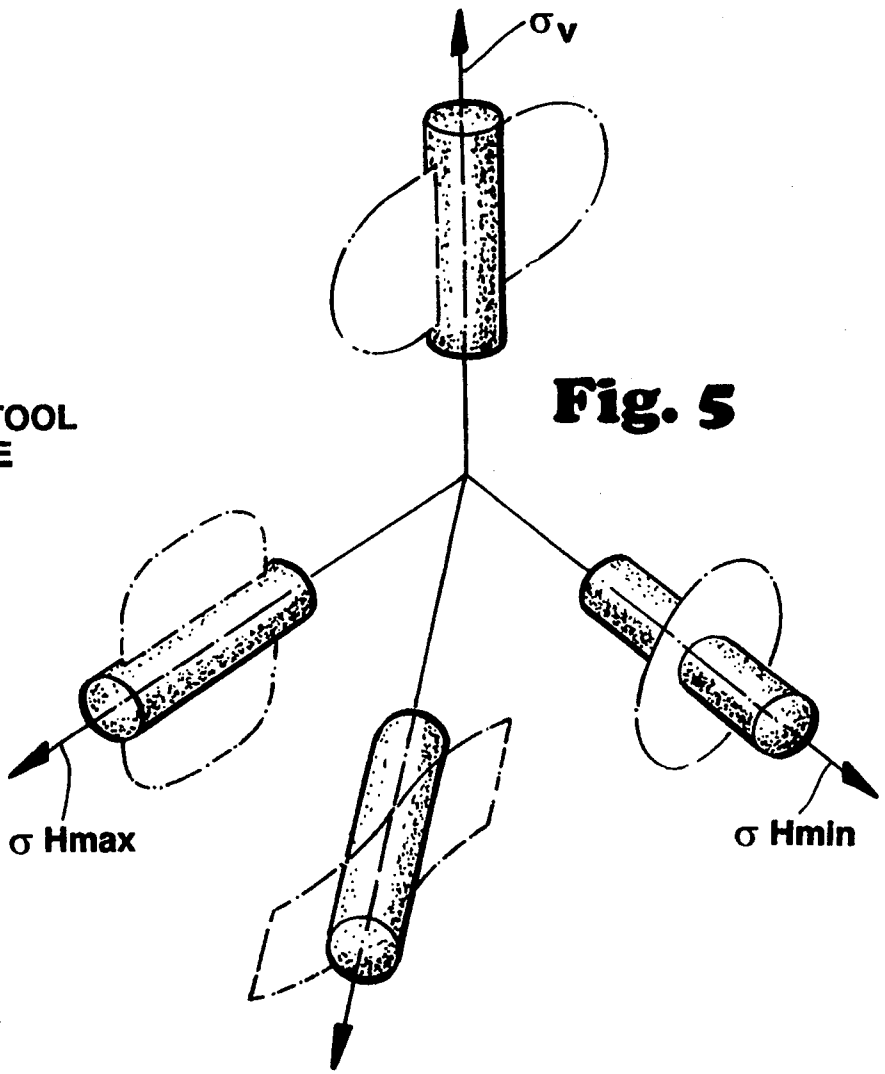
FIG. 5 illustrates the generalized fracture orientation with respect to wellbore orientation and stress orientation.

FIG. 5 is a three dimensional view of the relationship between the orientation of induced fractures and minimum and maximum stress orientation, where:

$\sigma_{H\,max}$=maximum in-situ horizontal stress orientation $\sigma_{H\,min}$=minimum in-situ horizontal stress orientation $\sigma_v$=vertical stress orientation.

The orientation of the induced fracture will be perpendicular to the minimum in situ stress as shown on the $\sigma_{H\,min}$ axis and parallel to the maximum in situ stress as shown on the $\sigma_{H\,max}$ axis. The induced fracture orientation will be at an approximately 45° angle to the core when the core is oriented at 45° angle to the maximum and minimum in situ stress. The orientation of the induced fracture will change with respect to the wellbore but not with respect to the minimum and maximum in situ stress orientation.

Figure 6:
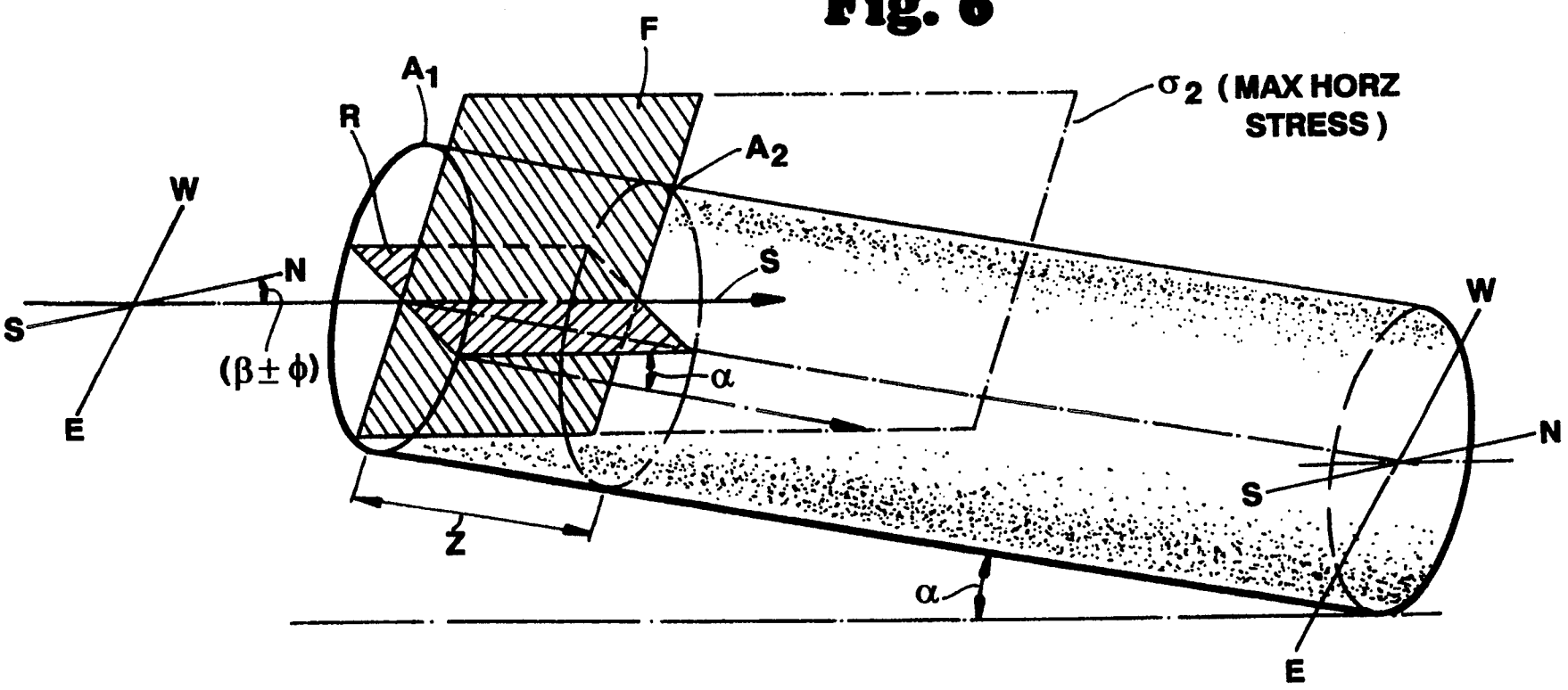
FIG. 6 is a graphical solution to the fracture orientation for deviated or horizontal wellbore/core.

In a vertical well, the images are taken in a perpendicular plane to the vertical axis of the well. As a result, the strike orientation can be determined directly in relation to the principal scribe orientation which is recalculated with respect to compass direction or azimuth. In a deviated well, the apparent strike must be corrected for the deviation. In addition, the spatial orientation can be determined by calculating dip angle and direction from sequential slice images. FIG. 6 illustrates a graphical solution for measuring the fracture orientation in a deviated or horizontal well using CT imagery where:

F=plane of induced fracture;

S=line of induced fracture strike;

$A_1$ to $A_2$=a series of sequential axial CT slice images from interval Z;

R=plane of longitudinal reconstructed CT image in horizontal plane;

$\alpha$=angle of wellbore deviation from horizontal plane;

$\phi$=angle of wellbore deviation form North;

$\beta$=angle of fracture trace deviation from $\phi$; and $\beta+\phi$=strike orientation from North.

The CT computer can be used to construct a longitudinal or horizontal image by reconstructing a series of axial slices. The fracture trace on the reconstructed longitudinal or horizontal image will represent the strike orientation. The same process as described above for a vertical well is then used to measure the azimuthal direction of the fracture trace.

3. Determining The Direction Of Fracture Propagation Through Measurement Of Borehole Deformations A highly sensitive multi-arm caliper, such as the Total Halliburton Extensionmeter, may also be used to determine the direction of fracture propagation. That tool is the subject of U.S. Pat. No. 4,673,890, which is hereby incorporated by reference. Other downhole tools that may be used to measure borehole deformations are depicted in U.S. Pat. Nos. 4,625,795 and 4,800,753, both of which are hereby incorporated by reference.

This method is the subject of a separate pending patent application which is also assigned to the assignee of the present application (application Ser. No. 902,108, filed Jun. 22, 1992). This method basically comprises the steps of exerting pressure on a subterranean formation by way of the wellbore, measuring the diametral displacements of the wellbore in three or more angularly offset directions at a location adjacent the formation as the pressure of the formation is increased, and then comparing the magnitudes of the displacements to detect and measure elastic anisotropy in the formation. The measurement of the in-situ elastic anisotropy in the form of directional diametral displacements at increments of pressure exerted on the formation are utilized to calculate directional elastic moduli in the rock formation and other factors relating to the mechanical behavior of the formation.

In carrying out this method, a wellbore is drilled into or through a subterranean formation in which it is desired to determine fracture related properties, e.g., the relationship between applied pressure and wellbore deformation which allows the calculation of in-situ rock elastic moduli and in-situ stresses. A knowledge of such fracturing related properties of a rock formation, as well as fracture direction and fracture width as a function of pressure prior to carrying out a fracture treatment in the formation, allows the fracture treatment to be planned and performed very efficiently, whereby desired results are obtained. In addition, knowing the fracture direction allows the optimum well spacing in a field to be determined as well as the establishment of the shape of the drainage area and the optimum placement of both vertical and horizontal wells.

Figure 7:
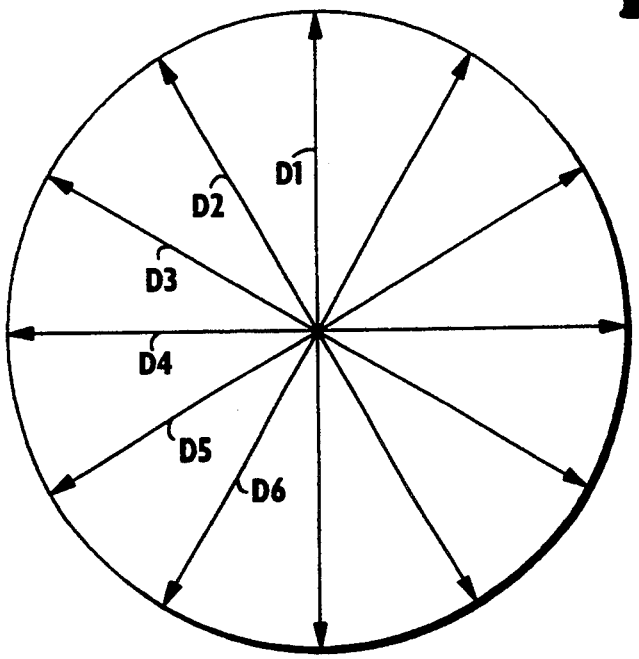
FIG. 7 represents a horizontal cross-section through a vertical wellbore showing the angularly offset directions in which wellbore diametral displacements are preferably measured.

Prior to casing or lining a wellbore penetrating a formation to be tested, a measurement tool of the type described in U.S. Pat. No. 4,673,890 is lowered through the wellbore to a point adjacent the formation in which fracture related properties are to be determined. The measurement tool includes packers whereby it can be isolated in the zone to be tested, and radially extendable arms are provided which engage the sides of the wellbore and measure initial diameter and diametral displacements in at least two angularly offset directions. Preferably, the measurement tool includes six pairs of oppositely positioned radially extendable arms whereby diameters and diametral displacements are measured in six equally spaced angularly offset directions as shown in FIG. 7. The measurement tool must have sufficient sensitivity to measure incremental displacements in micro inches.

After isolation, and once the extendable arms are in firm contact with the walls of the wellbore adjacent the formation to be tested, the tool continuously measures diametral displacements as the pressure exerted in the wellbore is increased. Generally, the measurement tool is connected to a string of drill pipe or the like and after being lowered and isolated in the wellbore adjacent the formation to be tested, the pipe and the portion of the wellbore containing the measurement tool are filled with a fluid such as an aqueous liquid. The measurement tool then measures the initial diameters of the wellbore in the angularly offset directions at the static liquid pressure exerted on the formation. The measurement tool is azimuthally orientated so that the individual polar directions of the measurements are known.

Figure 8:
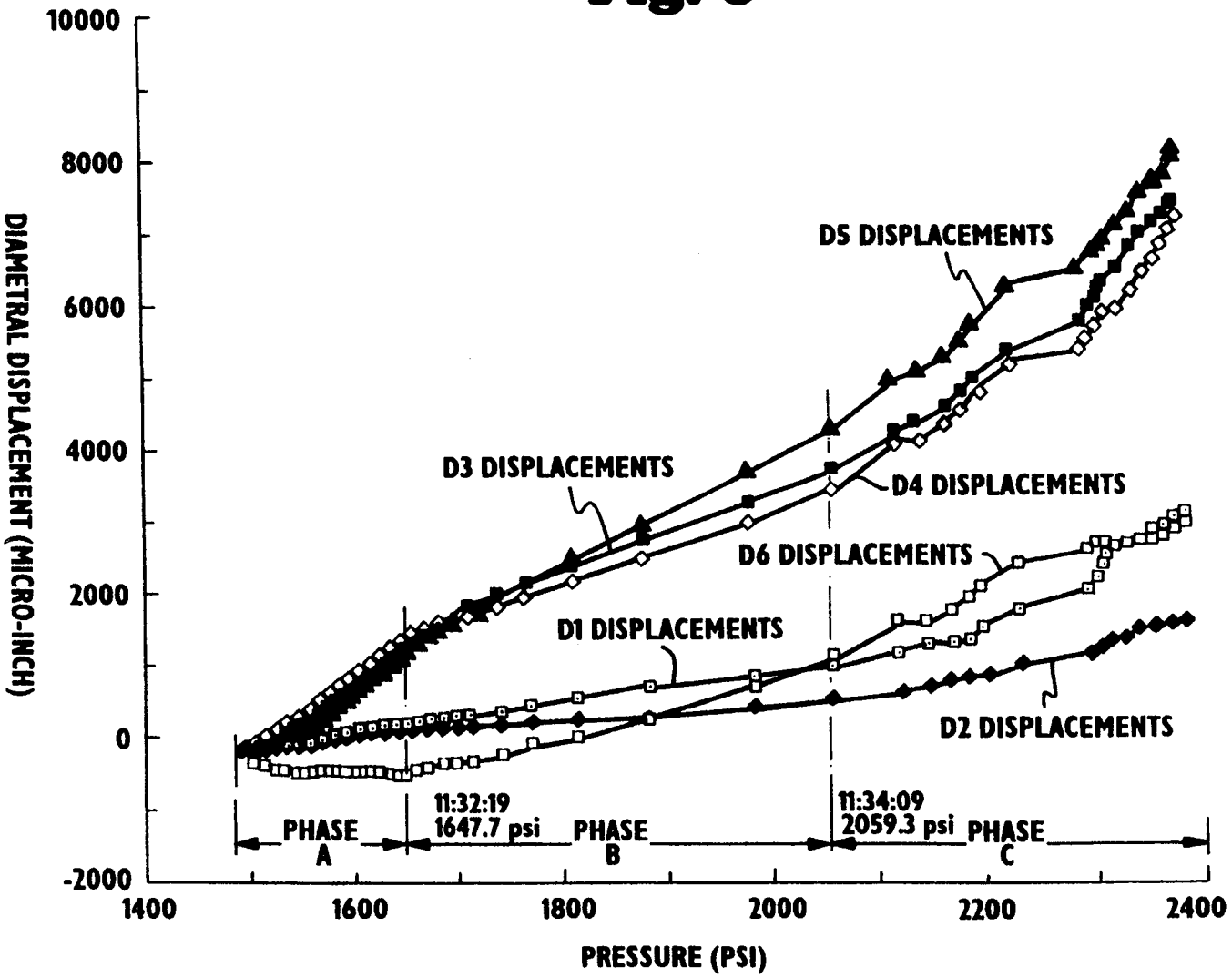
FIG. 8 is a graph showing the diametral displacements of a wellbore versus pressure.

Additional fluid is pumped into the wellbore thereby increasing the pressure exerted on the formation adjacent the measurement tool from the static fluid pressure to a pressure above the pressure at which one or more fractures are created in the formation. As the pressure is increased, the directional diametral displacements of the wellbore are measured at a minimum of two and preferably at a plurality of pressure increments. For example, the directional diametral measurements can be simultaneously made once each second during the time period over which the pressure is increased. The measurements are recorded and processed electronically whereby the magnitudes of the diametral displacements in the various directions can be compared, e.g., graphically as shown in FIG. 8. In-situ elastic anisotropy in the formation is shown if the magnitudes of the diametral displacements are unequal. Thus, the measurements are used to detect whether or not the rock formation being tested is in a state of elastic anisotropy, and the measurement data corresponding to pressure exerted on the formation is utilized to calculate in-situ rock moduli and other rock properties relating to fracturing. When the formation fractures, the measurement data at the time of the fracture, and thereafter, is utilized to determine fracture direction and fracture width as a function of pressure.

Thus, the method of the present invention basically comprises the steps of exerting increasing pressure on a formation by way of the wellbore, measuring the incremental diametral displacements of the wellbore in three or more angularly offset directions at a location adjacent the formation as the pressure on the formation is increased, and then comparing the magnitudes of the diametral displacements to determine if they are unequal and to thereby detect and measure elastic anisotropy in the formation.

The angularly offset directions are azimuthally oriented, and the incremental diametral displacements are preferably measured in a plurality of equally spaced angularly offset directions. Once the azimuthal orientation of formation anisotropy is known, the tool may be reoriented for the purpose of directly measuring maximum and minimum displacements aligned in the inferred plane of minimum and maximum stress.

Once the in-situ elastic anisotropy of a subterranean formation has been detected and measured as described above, directional elastic moduli, i.e., Young's modulus and/or shear modulus are determined using the pressure correlated displacement data obtained. That is, the Young's modulus of the formation in each direction is determined using the following formula:

$$E = \frac{(P_2 - P_1)D}{(W_2 - W_1)}(1 + \mu)$$

wherein

E represents Young's Modulus;

$P_1$ represents a first pressure;

$P_2$ represents a greater pressure;

D represents the initial wellbore diameter;

$W_1$ represents the diametral displacement of the wellbore at the first pressure ($P_1$); and $W_2$ represents the wellbore diametral displacement at the second pressure ($P_2$); and $\mu$ represents Poisson's Ratio.

Young's modulus values obtained in accordance with this invention using the above formula are close approximations of the actual Young's modulus values of the tested formation in the directions of the wellbore measurements. Young's modulus can be defined as the ratio of normal stress to the resulting strain in the direction of the applied stress, and is applicable for the linear range of the material; that is, where the ratio is a constant. In an anisotropic material, Young's modulus may vary with direction. In subterranean formations, the plane of applied stress is usually defined in the horizontal plane which is roughly parallel to bedding planes in rock strata where the bedding is horizontally aligned.

Poisson's ratio ($\mu$) can be defined as the ratio of lateral strain (contraction) to the axial strain (extension) for normal stress within the elastic limit.

Young's modulus is related to shear modulus by the formula:

$$E=2G(1+\mu)$$

wherein

E represents Young's modulus;

G represents shear modulus; and

Shear modulus can be defined as the ratio of shear stress to the resulting shear strain over the linear range of material.

Thus, once the approximate Young's modulus in a direction is calculated, shear modulus can also be calculated. Both shear modulus and Young's modulus are based on the elasticity of rock theory and are utilized to calculate various rock properties relating to fracturing as is well known by those skilled in the art. The term stress, as it is used here, can be defined as the internal force per unit of cross-sectional area on which the force acts. It can be resolved into normal and shear components which are perpendicular and parallel, respectively, to the area. Strain, as it is used herein, can be defined as the deformation per unit length and is also known as "unit deformation". Shear strain can be defined as the lateral deformation per unit length and is also known as "unit detrusion". The term "elastic moduli" is sometimes utilized herein to refer to both shear modulus and Young's modulus. The directional diametral displacement and elastic moduli data obtained in accordance with this invention can be utilized to verify in-situ stress orientation, verify or predict hydraulic fracture direction in the formation, and to design subsequent fracture treatments using techniques well known to those skilled in the art.

A preferred method for detecting and measuring in-situ elastic anisotropy in a subterranean rock formation penetrated by a wellbore generally comprises the steps of:

(a) placing a wellbore diameter and diametral displacement measurement tool in the wellbore adjacent the formation, the tool being capable of measuring wellbore initial diameters and diametral displacements in a plurality of azimuthally oriented angularly offset directions at an initial pressure and at two or more successive pressure increments;

(b) exerting initial pressure on the formation by way of the wellbore;

(c) increasing the pressure exerted on the formation;

(d) measuring the diameters at the initial pressure and the diametral displacements at the two or more successive pressure increments in each of the azimuthally oriented angularly offset directions;

(e) comparing the magnitudes of the diametral displacements to determine if they are unequal to thereby detect and measure in-situ elastic anisotropy in the formation; and (f) determining the approximate in-situ Young's modulus of the rock formation in each of the directions by multiplying the difference in pressure between two of the pressure increments by the initial diameter of the wellbore and by 1 plus Poisson's ratio and dividing the product obtained by the difference between the diametral displacements at the pressure increments.

A representative example of this method follows:

EXAMPLE

A wellbore measurement tool of the type described in U.S. Pat. No. 4,673,890 was used to test a subterranean formation. The measurement tool, connected to a string of tubing, was lowered to a location in the wellbore adjacent the formation to be tested that had been cored to a diameter of $7\frac{7}{8}''$, and the measurement tool was isolated by setting top and bottom packers. The string of tubing was filled with an aqueous liquid and the annulus between the tubing and the walls of the bore was pressured with nitrogen gas.

Figure 13:
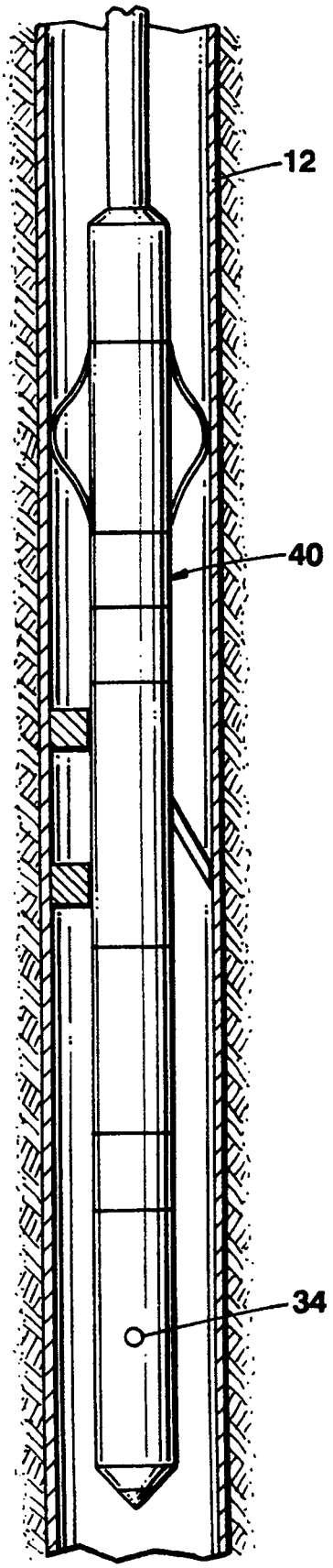
FIG. 13 is a cross-sectional view of a subterranean well within which is suspended exemplary wireline tool.

The measurement tool included six pairs of opposing radially extendable arms whereby initial diameters and diametral displacements were measured in a substantially horizontal plane in six angularly offset directions designated D1 through D6 as shown in FIG. 13. After the arms were extended and stabilized against the walls of the wellbore, the measurement tool was activated. Measurements were made and processed as the liquid pressure exerted on the formation was increased from the initial static liquid pressure by pumping additional liquid through the tubing against and into the tested formation at a rate of 3 gallons per minute.

The diametral displacement measurements made by the measurement tool while the pressure was increased from about 1490 psi (static liquid pressure) to about 2380 psi are presented graphically in FIG. 8. As shown, the diametral displacements are not equal thereby indicating elastic anisotropy. The data presented in FIG. 8 covers the period from the start of pumping 11:21:35 a.m. to fracture initiation at 11:37:19 a.m. During that period, the testing went through three distinct phases indicated in FIG. 8 by the letters A, B and C. In phase A, the measured displacements were not linear and remained substantially constant in the directions D1, D2 and D6 indicating a hard quadrant while D3, D4 and D5 changed dramatically indicating a soft quadrant. The cause for the non-linearity is speculated to be movements associated with further seating of the arms and/or the closing of micro fractures in the formation. At a pressure of about 1647.7 psi and time of 11:32:19 a.m., the early non-linearity came to an end, and a second phase (phase B) began during which the diametral displacements were generally linear. Phase B continued to the time of 11:34:09 a.m. and a pressure of 2059.3 psi whereupon the fracturing phase (phase C) began and the displacements again became non-linear.

When a fracture was induced at 11:37:19 a.m. there was a sudden change in the reading and shifting of the instrument. Prior to the shifting, seven one second diametral displacement readings were obtained from which the width of the induced fracture (the displacement in a direction perpendicular to the fracture direction) was determined to approximately 0.027 inches and the fracture direction was determined to N 67° E (magnetic).

The directional stress moduli of the test formation were calculated using the linear displacement dam obtained during phase B of the test period shown in FIG. 8. The calculations were made using the formulae set forth above, and the results are as follows:

| Direction | $W_1$, μ-inches | $W_2$, μ-inches | $W_2 - W_1$, μ-inches | E, $10^6$ psi |
|---|---|---|---|---|
| D1 | 343 | 1244 | 901 | 4.50 |
| D2 | 267 | 701 | 434 | 9.34 |
| D3 | 1670 | 4112 | 2442 | 1.66 |
| D4 | 1603 | 3882 | 2279 | 1.78 |
| D5 | 1508 | 4697 | 3189 | 1.27 |
| D6 | −350 | 1375 | 1725 | 2.35 |

From the values set forth above, it can be seen that the smallest difference between $W_2$ and $W_1$ took place in the direction D2 and the calculated Young's modulus is greatest in the direction D2. In this example, the fracture direction also corresponds to D2.

Figure 9:
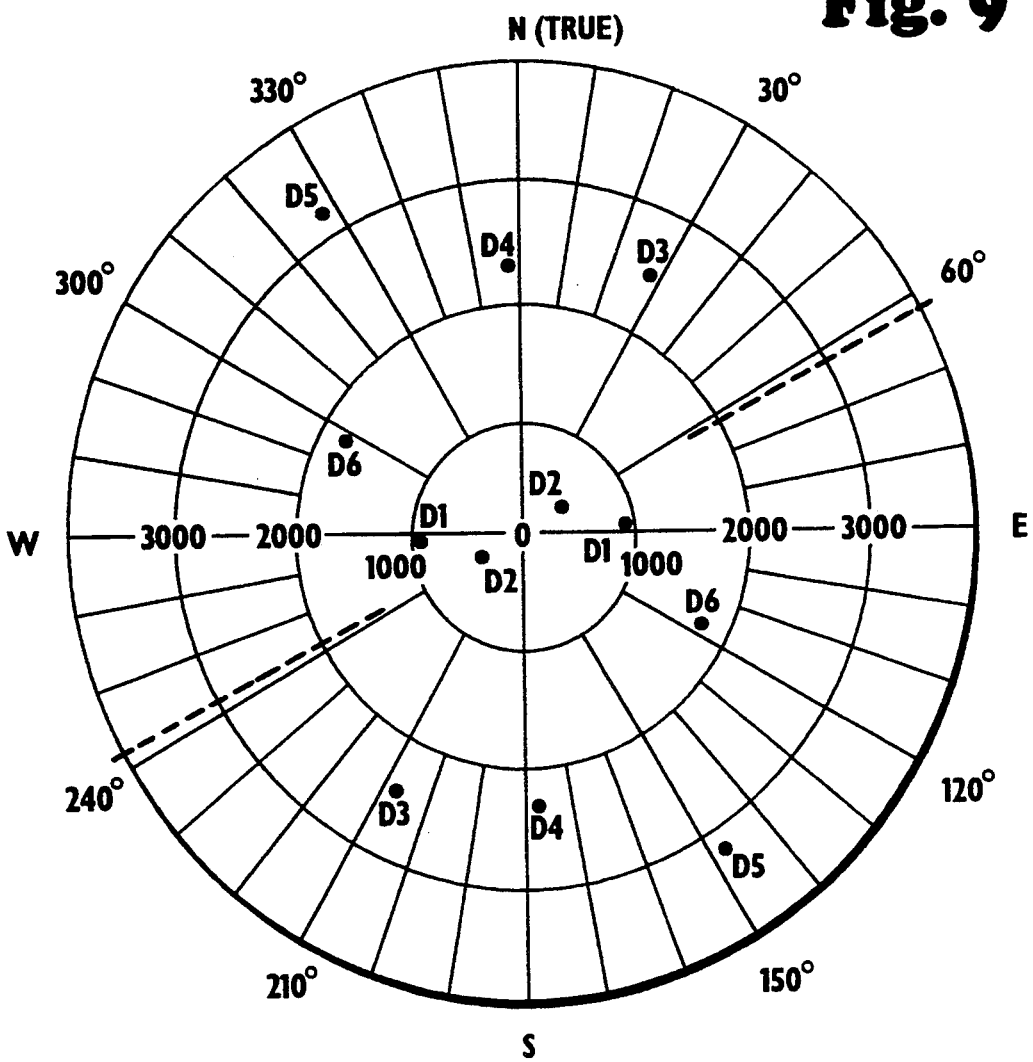
FIG. 9 is a polar graph showing the diametral enlargements of a wellbore as a result of the pressure increase over the time period identified as phase B in FIG. 8.

Referring now to FIG. 9, a polar plot of the differences in the displacements ($W_2 - W_1$) in μ-inches for D1 through D6 is presented, and the fracture direction indicated by the measuring tool of N 67° E is shown in dashed lines thereon. As shown in FIG. 9, the actual fracture direction substantially corresponds with the direction D2 in which the least wellbore diametral displacement difference took place and in which direction the formation had the highest elastic moduli.

4. Determining Fracture Orientation Through Strain Relaxation Measurement Techniques Additionally, fracture orientation may also be determined from strain relaxation measurements of an oriented core. This technique is well known in the prior art and fully discussed in the following papers, all of which are hereby incorporated by reference: (1) Teufel, L. W., *Strain Relaxation Method for Predicting Hydraulic Fracture Azimuth from Oriented Core,* SPE/DOE 9836 (1981); (2) Teufel, L. W., *Prediction of Hydraulic Fracture Azimuth From Anelastic Strain Recovery Measurements of Oriented Core,* Proceeding of 23rd Symposium on Rock Mechanics: Issues in Rock Mechanics, Ed. By R. E. Goodman and F. F. Hughes, p. 239, SME of AIME, New York, 1982; (3) Burton, T. L., *The Relation Between Recovery Reformation and In-Situ Stress Magnitudes,* SPE/DOE 11624 (1983); (4) El Rabaa, W. and Meadows, D. L., *Laboratory and Field Application of the Strain Relaxation Method,* SPE 15072 (1986); (5) El Rabaa, W., *Determination of the Stress Field and Fracture Direction in the Danian Chalk,* 1989.

In order to predict the azimuth of a hydraulic fracture, it is necessary to know the direction of the minimum horizontal compressive stress, because a hydraulic fracture propagates perpendicular to this stress direction. The strain relaxation method as outlined by Teufel, is based upon the assumption that an oriented sample of the formation, when retrieved from its downhole confined conditions, will relax (creep) in all directions. The magnitude of the recovered strain in any direction is proportional to the magnitude of the stress in that direction. Therefore, most recovered strain is aligned with the direction of maximum in-situ stress, or the direction of propagation of an induced hydraulic fracture. By instrumenting an oriented core immediately after its removal from the core barrel, a portion of the total recoverable strain can be measured.

In general, the following are the idealistic core properties demanded by the method to produce reliable results:

1. The core must be homogeneous and linearly viscoelastic. The core should also exhibit an isotropic creep compliance D(t) while maintaining a constant value of Poisson's ratio, i.e., Poisson's ratio is not time dependent;
2. The core must be free of cracks; and
3. It is preferable that the core is thermally isotropic, i.e., it has an equal coefficient of thermal expansion in all directions.

Prediction of fracture azimuth from three diametrical measurements of a core requires that (1) the in-situ principal stresses not be equal, and (2) the maximum stress be oriented in the vertical direction (due to the overburden weight). Despite variations found in formation properties (except for cracks), the method has been successfully applied.

The time dependent deformation that a core displays after its retrieval from a deep well is a result of displacements caused by the following effects:

1. Release of in-situ stresses, which consists of the overburden stress and the in-situ horizontal stresses;
2. Changes in core temperature; and/or
3. Release of pore pressure (what is left from the endogenous reservoir pressure plus that created by the drilling fluids).

Thus, for a core (with idealistic properties) taken from a vertical well, the change in its diameter for a specific period of time can be expressed by equation (1).

$$\Delta D = \Delta D_{st} - (\Delta D_p + \Delta D_{ov} + \Delta D_t)$$

where ΔD is the total displacement of the core diameter, and $\Delta D_{st}$, $\Delta D_p$, $\Delta D_{ov}$, $\Delta D_t$ are the diametrical displacements due to release of horizontal stresses, pore pressure, overburden and temperature changes, respectively. The total displacement could be positive or negative, i.e., cores could show expansion or contraction during the relaxation period. However, the only directional displacements are caused by release of (unequal) in-situ horizontal stresses (assuming that all other effects cause only non-directional diametrical deformation). Therefore, according to strain relaxation theory, the direction of maximum stress is taken as parallel to the direction of the core experiencing the most expansion during relaxation, or perpendicular to the direction of most contraction by superposition principles, thereby allowing determination of fracture orientation. Core contraction caused by release of pore pressure and loss of moisture can be minimized or prevented by sealing the core; however, this method is not always successful.

The specific techniques employed by this method generally involve taking an oriented piece of core from the bottom section of the core barrel (cores cut last) immediately upon its retrieval from the wellbore. (The core piece must be the most homogeneous and crack-free available.) After cleaning the core sample, it as sealed with a fast drying sealer or wrapped in a polyethylene wrapper.

The equipment used in this method includes a device base, displacement transducers, (3) aluminum ring (transducer carrier), and connecting rods. The aluminum ring can fit around a core piece of up to 4.25 in. diameter. The ring holds three pairs of DC displacement transducers to monitor three core diameters 60° apart and named X, Y and Z axes. Transducer output is 400 microvolts per $\pm 1\ \eta\epsilon$ (unit of strain) deformation of 4 in. diameter core. This output is measurable without amplification (unlike cantilever type devices utilizing strain gauges). The ring is adjustable up and down the core to accommodate various lengths of core up to 12 in. Vertical positioning of the ring allows one to choose the most homogeneous location for taking measurements along the core length.

The core piece is held independently of the ring in the center of the device by six adjustable arms. To account for the temperature effect on the device output, temperature is measured in two opposite places in the ring.

Since the measured displacements (strains) are 60° apart, the direction of the principal strains can be calculated by following equation:

$$\theta = 1/2 \tan^{-1} \frac{\sqrt{3}\ (\xi_y - \xi_z)}{2\xi_x - (\xi_y + \xi_z)}$$

where:

$\theta$ is the acute angle from the X-axis to the nearest principal axis. Terms $\epsilon_x$, $\epsilon_y$, and $\epsilon_z$ are the measured strain in the X, Y and Z axes respectively. Magnitude of maximum and minimum principal strains are calculated from the following equations:

$$\xi_{Hmax} = 1/3[\xi_x + \xi_y + \xi_z + \sqrt{2[(\xi_x - \xi_y)^2 + (\xi_y - \xi_z)^2 + (\xi_z - \xi_x)^2]}\ ]$$

$$\xi_{Hmin} = 1/3[\xi_x + \xi_y + \xi_z - \sqrt{2[(\xi_x - \xi_y)^2 + (\xi_y - \xi_x)^2 + (\xi_z - \xi_x)^2]}\ ]$$

Core relaxation monitoring begins after installing the core in the center of a transducer support ring device with its bottom end pointing downward (or as it was in the core barrel). A known angle between a major scribeline on the core sample and the X-axis of the device must be maintained in all tests for future azimuth correction. Pre-test preparations usually take 15–30 minutes. Core displacements and temperature of the device were logged at regular (10–30 min) intervals. It is desirable to conduct measurements in a constant or nearly stable temperature (±2° C.) environment. Measurements were taken until the next core was ready for testing or until complete stabilization status was reached. Calibration of the device was done on-site before and after tests using a totally relaxed homogeneous rock sample having a diameter similar to the one tested.

In applying the technique to actual field situations, there is one obvious, major complication. In analyzing an oriented core from a deep well, the strained measurements of the initial elastic recovery and part of the time-dependent (creep) recovery will be lost because of the finite time it takes to core the rock and bring the core to the surface. Since the elastic strain relief is unknown, it is essential to begin monitoring the time-dependent strain relief at the point as near as possible to the end of the elastic strain, i.e., it is necessary to quickly analyze the core in order to obtain the maximum amount of strain relief, and to minimize the error in determining the in-situ directions of the principle horizontal strains (stresses) from the relaxation data.

5. Observing Fracture Direction Through Use Of Circumferential Acoustic Scanning Tool Another useful method for determining fracture orientation is through the use of Halliburton's Circumferential Acoustic Scanning Tool (CAST) which provides a full borehole image during the fracturing procedure. The use of the CAST for determining the magnitude of the minimum principal horizontal stress is fully set forth in a pending application, which is also assigned to the assignee of this application (application Ser. No. 897,325, filed Jun. 11, 1992, by James J. Venditto, David E. McMechan, and Milton B. Enderlin).

The CAST is the subject of U.S. Pat. No. 5,044,462, which is hereby incorporated herein by reference. By way of background, the CAST provides full borehole imaging through use of a rotating ultrasonic transducer. The transducer, which is in full contact with the borehole fluid, emits high-frequency pulses which are reflected from the borehole wall. The projected pulses are sensed by the transducer, and a logging system measures and records reflected pulse amplitude and two-way travel time. The CAST provides a very thorough acoustic analysis of the wellbore as typically some 200 shots are recorded in each 360° of rotational sweep, and each rotational sweep images about 0.3" in the vertical direction; however, these parameters may be varied as the CAST has variable rotational speed and a selectable circumferential sampling rate, as well as variable vertical logging speeds.

The images produced by the CAST yield very useful information, not only about fracture direction, but also about stress magnitude, formation homogeneity, bedding planes, as well as other geological features. The amplitude and travel time logs are typically, presented as raster scan images. The raster scan televiewer images produce grey level images which can be processed to produce a variety of linear color scales to reflect amplitude and/or travel time variations.

However, it must be remembered that sonic energy, not light, is responsible for the illumination of the details of the interior of the borehole. The amount of illumination, otherwise known as gray shading, of a particular point of the amplitude image is determined by the amount of returning sonic energy; white indicates the highest amount of returned energy while black represents that very little, or essentially no sonic energy has returned from a particular shot.

Likewise, in the case of travel time, white shading represents a fast travel time, while black represents a very long travel time, or no return. Since travel time is normally dependent on the distance of the two-way traverse, it can be surmised that the objects which are light gray or white are relatively close to the transducer, and objects which are dark gray or black are relatively far away.

In general, fine grain, competent rocks, such as massive carbonates and tight sandstones, make good sonic reflectors. This means that televiewer images of these types of rocks would be white or light gray in amplitude, and probably travel time as well. On the other hand, shales and friable sandstones usually exhibit a rough, irregular reflective surface. Therefore, the images of such rocks are most likely to black or dark gray.

The CAST is very useful in fracture reconnaissance. Because the CAST is recording a 360° gap-free image, as opposed to simple log curves, spatial consideration such as fracture orientation, width, and density may be recognized and mapped. In particular, use of the CAST during an open hole microfrac test allows determination of the direction of fracture propagation.

Figure 11:
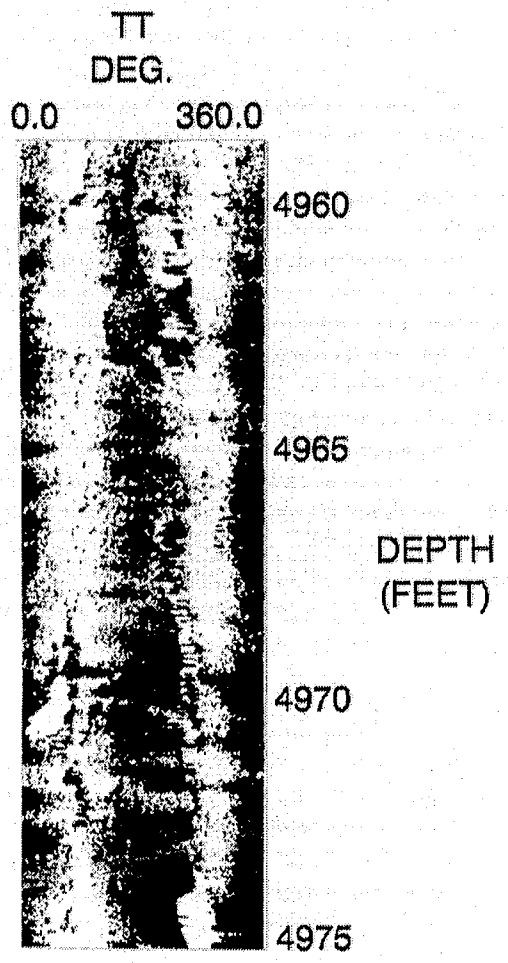
FIG. 11 is another photograph of a representation of an open fracture in a wellbore as shown on the travel time raster scan image produced by use of a circumferential acoustic scanning tool.
Figure 10:
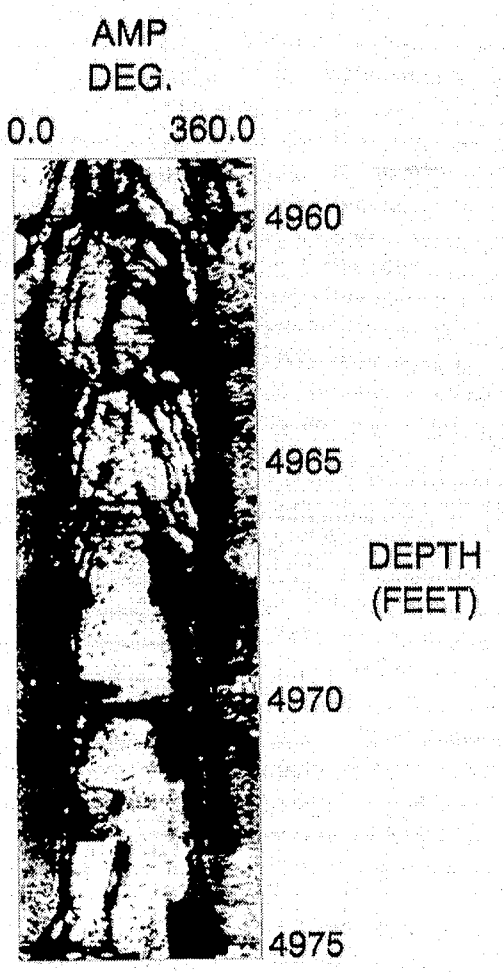
FIG. 10 is a photograph of a representation of an open fracture in a wellbore as shown on the amplitude raster scan image produced by use of a circumferential acoustic scanning tool.

In order to determine fracture orientation with use of the CAST, it is necessary to distinguish open fractures from closed fractures. First, a fracture pattern must be recognized in the amplitude image as shown in FIG. 10. Next, the analyst must look for the corresponding pattern expression in the travel time track. If no corresponding pattern exists, it can be assumed that no cavity exists where the fracture intersects the borehole; therefore, the fracture is closed. If a black shading does exist in the corresponding pattern of the travel time track as shown in FIG. 11, then the CAST has detected a cavity at the intersection of the fracture and the borehole; therefore, the fracture is assumed to be open.

Normally, the data obtained through use of the CAST is presented as two dimensional (horizontal and vertical) raster scan images of the "unwrapped" borehole. The horizontal axis of the CAST images provides information as to the orientation of the induced fractures, i.e., the CAST images are presented as if the borehole had been cut along the northerly direction and unwrapped.

The CAST may also be oriented through use of any of a variety of known gyroscopic or magnetic means that may be attached to the tool or to an orientation sub. One such suitable device is the Omni DG76® four-gimbal gyro platform available from Humphrey, Inc., 9212 Balboa Ave., San Diego, Calif. 92123, (619) 565-6631. Similar gyroscopic/accelerator technologies may be substituted for the orientation means which include other mechanical rate gyros, ring laser-type gyros, or fiber optics-type gyros.

Use of the CAST in conjunction with the open hole microfrac test will allow determination of fracture orientation. The wireline retrievable CAST may be lowered into the wellbore during the microfrac test. Thereafter, the pressure of the fracturing fluid is gradually increased until fractures are induced in the formation. The fracture may be directly observed from the images produced by the CAST as they are initiated in the formation. In particular, as set forth above, the opening of the fractures is first observed in the amplitude image, and then confirmed in the travel time track. Thus, by noting the orientation of the fractures shown on the images produced by the CAST, the direction of the fracture propagation may be determined.

Typically, any of the aforementioned techniques for determining the direction of fracture propagation may be performed at various levels within a wellbore, e.g., above and below the region of the formation of particular interest. After determining the direction of fracture propagation, drilling operations may be continued and casing may be cemented in the well. Thereafter, perforating devices are aligned and oriented such that the perforations are aligned with the previously determined direction of fracture propagation, thereby eliminating the near wellbore tortuosity phenomenon discussed above.

Although this invention has been discussed in the context of several representative methods for determining the existing state of stress within a field, and the direction of fracture propagation, the invention should not be considered limited to the representative methods discussed herein. Rather, the invention should be construed to cover all methods of determining the direction of fracture propagating within a given field.

After the direction of fracture propagation has been determined, a perforating device must be oriented so as to align the perforations produced by said device with the previously determined direction of hydraulic propagation. An improved method and apparatus for orienting a particular well completion to take advantage of directional reservoir characteristics is fully set forth in a pending application, which is also assigned to the assignee of this application (application Ser. No. 897,257, field Jun. 11, 1992). These reservoir characteristics may include directionally oriented stress/strain properties, permeability, prior or secondary porosity, grain size/-shape, or sorting characteristics. This method and technique permits the perforating gun of a wireline tool to be properly oriented in either a vertical or non-vertical wellbore in accordance with an orienting mechanism. A wireline tool is described whose lower section contains a gun section that is rotatably joined to an upper section of the tool. The lower section may be rotated by a rotating assembly about a slip joint to move independently of the upper section. The rotating assembly may comprise a mechanical, hydraulic or electrical means of imparting rotation. In addition, the invention provides for a surface display such that operators on the surface may verity directional orientation of the charges prior to initiating them. Alternative embodiments are provided for practicing this inventive method using multiple passes into the well which involve less risk of damage to portions of the well tool.

Figure 12:
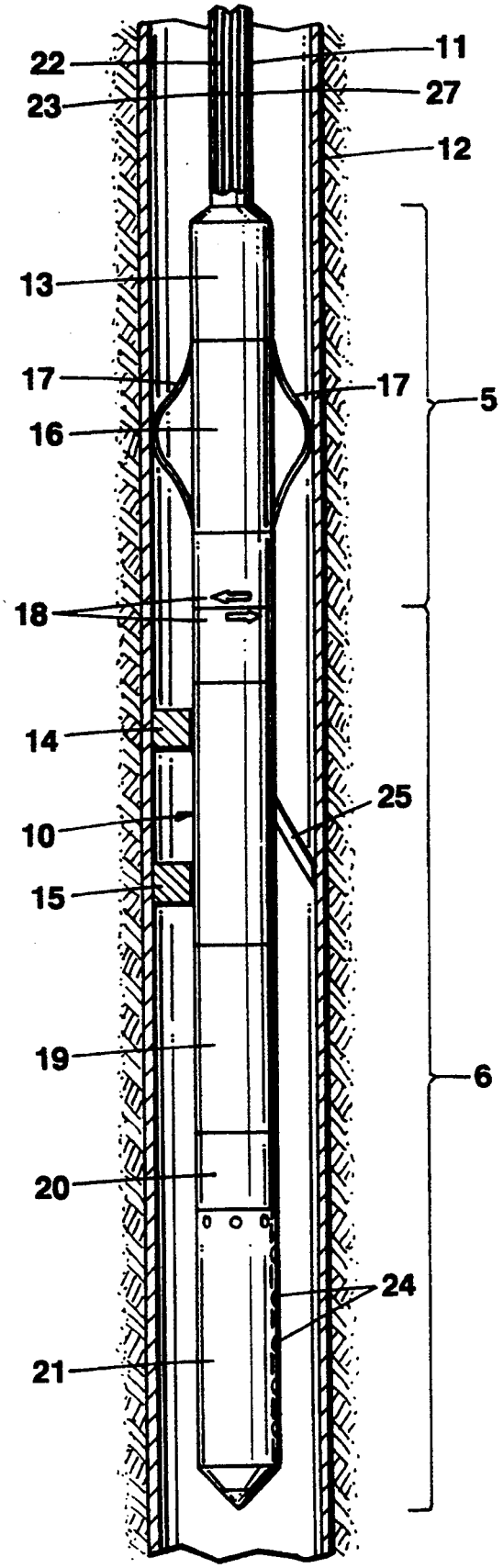
FIG. 12 is a cross-sectional view of a subterranean well within which is suspended exemplary wireline tool.

Referring to FIG. 12, wireline tool 10 is suspended by means of logging cable 11 within borehole 12. Wireline tool 10 comprises upper section 5, swivel joint assembly 18, and lower section 6. Upper section 5 comprises a casing collar locator 13, motor control section 16 and centralizer/slip assembly 17. Lower section 6 preferably comprises orientation sub 19, shock absorber 20, and gun section 21. Standoffs 14 and 15 and decentralizer 25 may be included in some embodiments. Logging cable 11 preferably includes a D/C power conduit 22 and A/C power conduit 23. A/C power conduit 23 attaches, by means of a transformer coupling, to charges 24 within gun section 21. Charges 24 preferably comprise shaped charges or similar charges which direct the force of the charge in a particular direction. Charges 24 are placed within a generally vertically aligned, or a narrow angular pattern within gun section 21.

Orientation sub 19 includes an orientation means sufficient to determine an azimuth with respect to magnetic north. The orientation means may comprise any of a number of gyroscopic/accelerometer devices which are often used as navigation tools. One such suitable device is the Omni DG76 ® four-gimbal gyro platform available from Humphrey, Inc., 9212 Balboa Ave., San Diego, Calif. 92123, (619) 565-6631. Similar gyroscopic-/accelerator technologies may be substituted for the orientation means which include other mechanical rate gyros, ring laser-type gyros, or fiber optics-type gyros.

Azimuthal information may then be provided, via transmission means 27 to a distant display such as surface display through which it may be interpreted by operators. Casing collar locator 13 preferably includes a depth sensor device, of types which are known in the art, which is connected by transmission means 27 to a distant display.

In operation, wireline tool 10 is suspended from logging cable 11 and lowered into borehole 12. Casing collar locator 13 is used to place the tool at an approximated predetermined depth and transmits depth information, via transmission means 27 to a remote surface display. When the desired depth is reached, centralizer/slip assembly 17 is set against the casing of borehole 12 to prevent upper section 5 from rotating with respect to borehole 12. Standoffs 14 and 15 and decentralizer 25 may additionally be set against the casing for added stability.

To accomplish the rotation of lower section 6, motor and control unit 16 is activated. Motor and control unit 16 is associated with D/C power conduit 22 such that operation of the unit is powered with D/C power. Motor and control unit 16 may comprise any of a number of mechanical, hydraulic, or electric devices known in the art for accomplishing such rotation.

Due to the imparted rotation, lower section 6 will rotate about swivel joint 18 with respect to both upper section 5 and borehole 12. Swivel joint assembly 18 preferably includes a pair of rotatably joined cylinders which rotate with respect to each other upon actuation by a motor and control unit or similar power means. The azimuthal orientation of lower section 6 is determined by the orientation means within orientation sub 19, and the orientation information transmitted via transmission means 27 to a distant display.

The distant display may comprise a number of digital and/or analog displays which preferably show a surface operator a combination of downhole readings describing the position and/or orientation of wireline tool 10.

Once the operator has determined from surface display 28 that wireline tool 10 is in the desired position in terms of depth and azimuthal orientation, he may initiate charges 24 of perforating gun 21. Such initiation is accomplished by energizing A/C power conduit 23. Shock absorber 20 helps protect the remaining portions of wireline tool 10 from the shock associated with detonation of charges within perforating gun 21.

An alternative embodiment of the present invention may be used to provide greater protection to portions of the orientation sub against shock generated by detonation of charges 24. In this embodiment, two passes into the well are required. In the first pass, a wireline tool 40 is suspended within the borehole 12. Exemplary wireline tool 40, seen in FIG. 13, is similar to the previously described wireline tool 10 in most respects. However, gun section 21 is modified in tool 40 such that charges 24 are replaced with tracer gun 34. Tool 40 is lowered to a desired depth in the same manner as was previously described in relation to wireline tool 10. Centralizer/-slip assembly 17 and standoffs 14 and 15 are set. Gun section 21 is rotated in the same way as was done with tool 10.

Tracer gun 34 is designed to place a radioactive marker within or upon the borehole wall or casing of borehole 12 upon energizing of A/C power conduit 23. In one highly preferred embodiment, tracer gun 34 comprises a single-shot gun which fires a radioactive pellet. In an alternative embodiment, gun 34 comprises a pump/ejector assembly which projects a liquid isotope onto the wall. Once the marker or pellet has been emplaced, tool 40 is removed from borehole 12.

Figure 14:
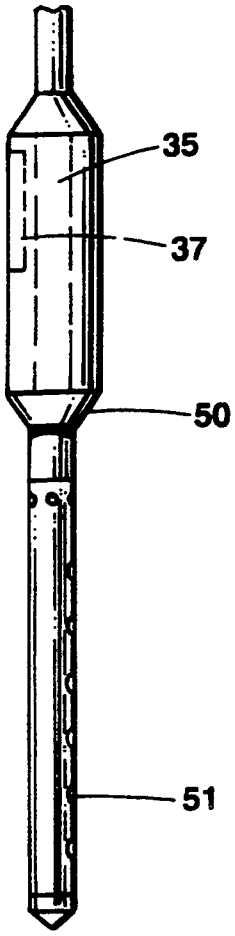
FIGS. 14–15 illustrate an exemplary directional radiation detector that may be used in accordance with the present invention.
Figure 15:
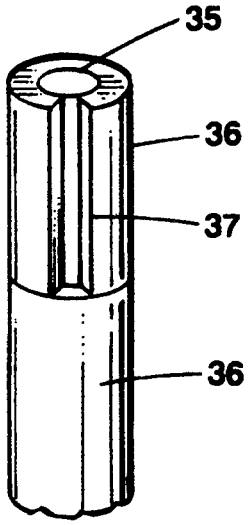

The second pass into the well is accomplished by lowering wireline tool 50 into borehole 12. Wireline tool 50 is also similar to exemplary wireline tool 10 in most respects. However, in tool 50, orientation means 26 within orientation sub 19 is replaced by a directional radiation detector 35, illustrated in FIGS. 14–15, which is suitable for determining the angular orientation of tool 50 with respect to the previously implanted radioactive pellet or marker. Detector 35 may also be connected by transmission means 27 to a distant display. As may best be seen in FIG. 15, exemplary detector 35 comprises a device capable of receiving and detecting the presence of gamma radiation as is generally known in the art. The housing surrounding detector 35 is preferably shielded against passage of gamma radiation over portions of its surface by shielding 36. Detector 35 may be located proximate the central axis of orientation sub 19. Selective exposure of detector 36 to gamma radiation is permitted by a narrow angular slot or window 37 along the longitudinal axis of tool 50. FIG. 14 illustrates a preferred placement for detector 35 wherein slot or window 37 is located along the opposite side of tool 50 from the direction of firing for perforating charges 51, to provide enhanced protection of the detector from the charges.

The portion of tool 50 containing detector 35 should be rotated in a manner similar to that described above for portions of tool 10. Since detector 35 obtains only selective detection of radiation through window 37, the amount of radiation detected from the preplaced radioactive marker will be greater when window 37 is approximately facing the marker. When detector 35 and window 37 are rotated, the angular direction of the preplaced radioactive marker within borehole 12 may be determined from the intensity of radiation detected at different angular positions. Preferably, the detector portion of tool 50 should be rotated a number of times slowly to ensure that an accurate determination has been made of the position of the marker.

As described previously, tool 50 is lowered to a predetermined depth within borehole 12 and a centralizer set. This depth should be proximate the location at which the radioactive marker was previously placed. The lower section of tool 50 is then angularly adjusted with respect to the radioactive marker as determined using the distant display. Since charges 51 are preferably located along the opposite side of tool 50 from window 37, the lower portion of tool 50 will have to be rotated 180° after the location of the radioactive marker has been made. Finally, charges 51 may be initiated to perforated the casing at the desired depth and angular orientation.

Regardless of the method chosen to determine fracture orientation, it is not necessary that the perforations be exactly aligned along an axis perpendicular to the minimum principle stress existing within a formation. Rather, the invention should be construed to cover techniques that result in fractures being initiated within perforation tunnels oriented within plus or minus fifteen degrees of the direction of fracture propagation. This variation is to be expected due to the inherent inaccuracies of the devices and methods employed to determine the direction of fracture propagation, and those employed to orient the perforating devices. Optimum benefits of the present inventive method will be realized if the perforation tunnels are aligned exactly along an axis perpendicular to the direction of the minimum principle stress existing within the field. Nevertheless, significant benefits in fracturing operations may also be realized if the perforation tunnels are oriented within the ranges specified above. However, the magnitude of the benefits to be achieved by this method will decrease as the degree of nonalignment of the perforation tunnels increase, albeit not in a linear relationship.

Moreover, it is not necessary that the direction of fracture propagation be determined at each and every well within a field or region. Rather, it is believed that after employing the methods and techniques disclosed and claimed herein to determine the direction of fracture propagation at a sufficient number of strategically located wells within a field or region (e.g. wells at the field boundaries), if the results obtained thereby are in substantial agreement, the stress pattern existing in the formation throughout a particular geographic region (or maybe for the entire region) may be determined. The number of wells that must be tested in order to determine the region-wide stress pattern will depend upon a multitude of factors, but it is believed that the direction of fracture propagation should be determined at least three wells that are strategically positioned or bounded on the region in order to have sufficient data from which to infer the direction of stress existing throughout the region. If this technique is employed, then at subsequent wells, it would only be necessary to align the perforating device with the previously determined field or region wide direction of fracture propagation and fracture the well. Through this technique, the additional time and expense of determining fracture orientation at each and every well may be avoided. This technique for determining the direction of fracture propagation on a field or region wide basis is also within the scope of the present invention.

Additionally, in certain situations, it may be desirable to perforate a given well in the direction of natural fractures existing within the formation. Of course, these fractures may or may not be aligned with the present stresses within the formation. Nevertheless, by perforating in the direction of such fractures, production of hydrocarbons may be increased. In particular, through use of the Computed Tomography ("CT") technique or the oriented CAST tool to determine fracture direction, both of which are disclosed herein, with or without an open hole microfrac test, it is possible to determine the direction of natural fracture orientation. Therefore, aligning perforations with the previously determined direction of natural fractures within a formation should also be considered as within the scope of the present invention.

Through use of the techniques disclosed herein, the direction of fracture propagation, or natural fractures, within a given formation may be determined. Thereafter, a perforating device may be oriented such that the perforations produced by such a device may be aligned with the previously determined direction and fracturing operations performed to complete the well. Of course, the present methods may be employed in both vertical and deviated wells; e.g. horizontal or wells drilled at an angle relative to a vertical well.

Additionally, it may be desirable in relatively loosely consolidated or relatively unconsolidated formations to further control sand production by placing a particle retaining compound in the formation proximate the perforations. The formation particle retaining compound may be an appropriate resinous compound, such as a resinous fluid or a resin-coated sand, or may include a plasticizing compound which will set or harden within the formation and restrict sand production from the well. Such formation stablizing further operates in accordance with the present invention to stabilize the formation during a subsequent fracturing operation.

Where the particle retaining compound is introduced into the wellbore subsequent to the performance of a fracturing operation, the compound will serve to further stabilize proppant placed during the fracturing job and any fines from the formation. In one preferred implementation, it is believed that a compound such as a furan resin or an epoxy plastic may be utilized to stabilize an unconsolidated or relatively unconsolidated formation as described herein.

Many modifications and variations may be made and the techniques and structures described and illustrated herein without departing substantially from the scope of the present invention. Accordingly, it should be readily understood that the techniques and embodiments described and illustrated herein are illustrative only, and are not to be considered as limitations upon the scope of the present invention.

What is claimed is:

1. A method for controlling the flow of sand and other solids from a wellbore, comprising the steps of:

determining the azimuthal direction of the maximum horizontal stress field within a formation having a wellbore formed therein;

orienting a perforating device capable of perforating said formation Within said wellbore such that perforations produced by said perforating device are substantially aligned with said azimuthal direction of said maximum horizontal stress field; and actuating said perforation device so as to perforate said formation in the direction of said azimuthal direction of said maximum horizontal stress field; and supplying a particle retaining compound to said formation proximate said perforated formation.

2. The method of claim 1, wherein said particle retaining compound comprises a resinous fluid.

3. The method of claim 1, further comprising the step of fracturing said formation generally through said perforation substantially aligned with said azimuthal direction of said maximum horizontal stress field.

4. The method of claim 1, wherein said step of fracturing said formation is performed after said step of supplying a particle retaining compound to said formation proximate said perforated formation.

5. The method of claim 1, wherein said step of determining the direction of said maximum horizontal stress field comprises the steps of:

obtaining an oriented core from said formation after a fracture has been initiated in said formation; and observing the direction of fracture propagation within said oriented core.

6. The method of claim 1, wherein said step of determining the azimuthal direction of the maximum horizontal stress field comprises the steps of:

obtaining an oriented core from said formation after a fracture has been initiated in said formation; and performing strain relaxation measurements on said oriented core to determine the direction of minimum principle stress existing within said core.

7. The method of claim 1, wherein said step of determining the azimuthal direction of the maximum horizontal stress field comprises the steps of:

measuring the cross-sectional shape of the wellbore formed in said formation before fractures are initiated in said formation;

measuring the cross-sectional shape of said wellbore after fractures have been initiated in said formation; and calculating the direction of maximum horizontal stress within said formation based upon the change in the cross-sectional shape of said wellbore as determined by said measurements.

8. The method of claim 1, wherein said step of determining the direction maximum horizontal stress comprises the steps of:

positioning an oriented circumferential acoustic scanning tool into said wellbore;

inducing fractures in said formation by performing an open hole microfrac test in said wellbore; and observing the orientation of said fractures in said formation by use of said circumferential acoustic scanning tool, said observed fractures aligned with said direction of maximum horizontal stress.

9. A method for completing a well in a potentially sand producing formation comprising the steps of:

determining the direction of the maximum horizontal stress field within the formation;

orienting a perforating gun within said formation, said perforating gun configured to perforate said formation substantially along a single vertical plane, said perforating gun oriented with said single vertical plane extending generally in the direction of said maximum horizontal stress field; and actuating said perforating gun to perforate said formation and establish perforations in said formation extending generally in the direction of said maximum horizontal stress field; and applying a resinous compound to said formation proximate said perforations.

10. The method of claim 9, further comprising the step of pumping a fracturing fluid into said perforations to propagate fractures into said formation.

11. The method of claim 10, wherein said step of pumping a fracturing fluid into said perforations is performed prior to said step of applying a resinous compound to said formation proximate said perforations.

12. The method of claim 9, wherein said step of determining the direction of said maximum horizontal stress field within said formation comprises the steps of:

obtaining an oriented core from said formation after a fracture has been initiated in said formation; and observing the direction of fracture propagation within said oriented core.

13. The method of claim 9, wherein said step of determining the direction of said maximum horizontal stress field within said formation comprises the steps of:

obtaining an oriented core from said formation after a fracture has been initiated in said formation; and performing strain relaxation measurements on said oriented core to determine the direction of maximum horizontal stress existing within said core and within said formation.

14. The method of claim 9, wherein said step of determining the direction of said maximum horizontal stress field within said formation comprises the steps of:

measuring the cross-sectional shape of the wellbore formed in said formation before fractures are initiated in said formation;

measuring the cross-sectional shape of said wellbore after fractures have been initiated in said formation; and calculating the direction of maximum horizontal stress within said formation based upon the change in the cross-sectional shape of said wellbore as determined by said measurements.

* * * * *